US006145826A

United States Patent [19]

Kawata

[11] Patent Number: 6,145,826

[45] Date of Patent: Nov. 14, 2000

[54] IMAGE FORMING APPARATUS

[75] Inventor: Wataru Kawata, Kashiwa, Japan

[73] Assignee: Canon Kabushiki Kaisha, Tokyo, Japan

[21] Appl. No.: 09/176,310

[22] Filed: Oct. 22, 1998

[30] Foreign Application Priority Data

Oct. 27, 1997 [JP] Japan ..... 9-311292
Oct. 27, 1997 [JP] Japan ..... 9-311293

[51] Int. Cl.[7] ..... B65H 33/04; B65H 1/00; B65H 31/04; B65H 43/04; B65H 31/10

[52] U.S. Cl. ..... 270/58.28; 270/58.13; 271/162; 271/213; 271/215; 271/217

[58] Field of Search ..... 355/407, 408; 399/16, 361, 369, 371, 404, 405, 407, 411; 270/30.01, 30.1, 52.06, 58.07, 58.09, 58.13, 58.19, 58.28; 271/162, 176, 201, 213, 214, 215, 217

[56] References Cited

U.S. PATENT DOCUMENTS 3,722,879 3/1973 Johnston et al. ..... 271/47
4,189,133 2/1980 Arrasmith et al. ..... 270/61
4,951,935 8/1990 Oikawa ..... 271/208
5,621,501 4/1997 Matsuo et al. ..... 355/75
5,911,414 6/1999 Kato et al. ..... 270/58.07
5,926,684 7/1999 Horiuchi et al. ..... 399/402

*Primary Examiner*—Russell Adams
*Assistant Examiner*—Rodney E Fuller
*Attorney, Agent, or Firm*—Fitzpatrick, Cella, Harper & Scinto

[57] ABSTRACT

A sheet processing apparatus has a tray supported in a vertically movable manner and adapted to support sheets discharged from the main body of the sheet processing apparatus, and an elevate/lower unit for elevating or lowering the tray and having a detector for outputting a detection signal by detecting an uppermost one from among the sheets discharged in succession and stacked on the tray and a controller for controlling the elevate/lower unit so as to lower the tray in response to the detection signal inputted from the detector. The controller, after the input of the detection signal from the detector, if the input of the detection signal is not terminated even after lowering of the tray by a predetermined amount, executes a serial control of lowering the tray until the input of the detection signal is terminated, then elevating the tray until the detection signal is inputted, and lowering the tray until the detection signal is terminated.

7 Claims, 22 Drawing Sheets

IMAGE FORMING APPARATUS

BACKGROUND OF THE INVENTION

1. Field of the Invention

The present invention relates to a sheet processing apparatus having sheet stacking means for stacking discharged sheets in succession, and to an image forming apparatus provided with such sheet processing apparatus.

2. Related Background Art

Among the sheet processing apparatus, there is already known a configuration in which the top surface of the sheets stacked on the stacking tray always remains at a predetermined height. In such configuration, there are provided a sheet stacking tray on which the discharged sheets are stacked in succession, elevate/lower means for elevating or lowering the tray, a top surface sensor for detecting the top surface of the uppermost one of the sheets stacked on the tray, and control means for controlling the elevate/lower means according to the result of detection. Such top surface sensor is comprised, for example, of a transmissive photosensor having a light emitting unit and a light receiving unit respectively at the left and right sides of the sheet stacking tray in such a manner that the optical axis of the sensor crosses transversally above the sheet stacking tray.

As the discharged sheets are stacked in succession on the stacking tray, the position of the uppermost sheet becomes higher. The optical axis is intercepted by the uppermost sheet when it reaches the optical axis, whereby the sensor detects the uppermost sheet. Based on the result of such detection, the control means controls the elevate/lower means to lower the stacking tray. The stacking trays descends by an amount allowing the intercepted optical axis is restored. The above-described operation is repeated for every sheet stacking on the stacking tray whereby the height from the sheet discharging outlet to the uppermost stacked sheet, or the dropping height of the sheet at discharge, can be maintained constant. Thus, satisfactory discharge and stacking of sheets can be ensured.

However, the above-described conventional configuration functions satisfactorily when the discharged sheets are stacked in a satisfactorily flat state on the stacking sheet, but the following drawbacks are encountered in cases where the discharged sheet is stacked in a partly lifted state.

More specifically, in the discharging and stacking of a sheet on the preceding sheets which are already stacked in a satisfactorily flat state, if the discharged sheet is stacked in a partially lifted state floating from the preceding sheets, for example if the front end of the discharged sheet does not reach the front end of the preceding stacked sheets and the rear end of the discharged sheet is lifted up, leaning on the lateral wall of the sheet processing apparatus (hereinafter such lifted or floating portion being called "deformed portion"), the top surface sensor may detect such a deformed portion. In such a case, the stacking tray is lowered until the deformed portion completely clears the top surface sensor, so that the dropping height for the next sheet becomes larger than in the ordinary state, and the next sheet cannot be ensured of satisfactory discharge and stacking. Also, if the deformed portion of the sheet is not resolved by the descent of the stacking tray, the deformed portion is folded by the sheet discharged and stacked next.

SUMMARY OF THE INVENTION

In consideration of the foregoing, the an object of the present invention is to provide a sheet processing apparatus capable of satisfactory discharge and stacking of sheet on sheet stacking means (corresponding to the stacking tray mentioned above), including prevention of folding of the deformed portion of the sheet, and to provide an image forming apparatus provided with such sheet processing apparatus.

The above-mentioned objects can be attained, according to the present invention, by a sheet processing apparatus provided sheet stacking means supported in vertically movable manner and adapted to support the sheets discharged from the main body of the sheet processing apparatus and elevate/lower means for elevating or lowering the sheet stacking means. The apparatus comprises detection means for detecting the uppermost one of the sheets discharged in succession and stacked on the sheet stacking means thereby outputting a detection signal, and control means for so controlling the elevate/lower means as to lower the sheet stacking means in response to the entry of the detection signal from the detection means. When the control means is adapted, in case, after the input of the detection signal from the detection means, the input of such detection signal is not terminated even after the descent of the sheet stacking means by a predetermined amount, to execute a control process of lowering the sheet stacking means until the input of the detection signal is terminated, and then elevating the sheet stacking means until the detection signal is outputted again and lowering the sheet stacking means until the detection signal is terminated.

More specifically, the sheet processing apparatus is featured by a fact that the detection means is comprised of a transmissive photosensor in which an optical axis is formed between a light emitting unit and a light receiving unit and that the detection signal is outputted by the interception of the optical axis and is terminated by the restoration thereof. In addition, the sheet processing apparatus is featured by a fact that the sensor is so positioned that the optical axis thereof is directed transversally to the discharging direction of the sheet, above the sheet stacking means.

The sheet processing apparatus is also featured by a sensor positioned so that the optical axis thereof becomes parallel to the rear edge of the sheet on the sheet stacking means, above the base portion thereof, so that the drive source of the elevate/lower means is provided in the sheet stacking means, and so that the drive source of the elevate/lower means is provided in the main body of the sheet processing apparatus.

The control means is adapted, in case, after the input of the detection signal from the top surface detection means, the input of the detection signal is not terminated even by the descent of the sheet stacking means by a predetermined amount, to execute serial corrective control of at first lowering the sheet stacking means until the input of the detection signal is terminated, then elevating the sheet stacking means until the detection signal is generated and lowering the sheet stacking means until the detection signal is terminated, thereby eliminating the deformed portion of the sheet and improving the alignment of sheets on the sheet stacking means.

Thus the present invention enables satisfactory discharge and stacking of sheets onto the sheet stacking means, including prevention of folding of the deformed portion of the sheet.

DESCRIPTION OF THE PREFERRED EMBODIMENTS

Now the present invention will be clarified in detail by preferred embodiments thereof, with reference to the attached drawings.

[First Embodiment]

Figure 21:
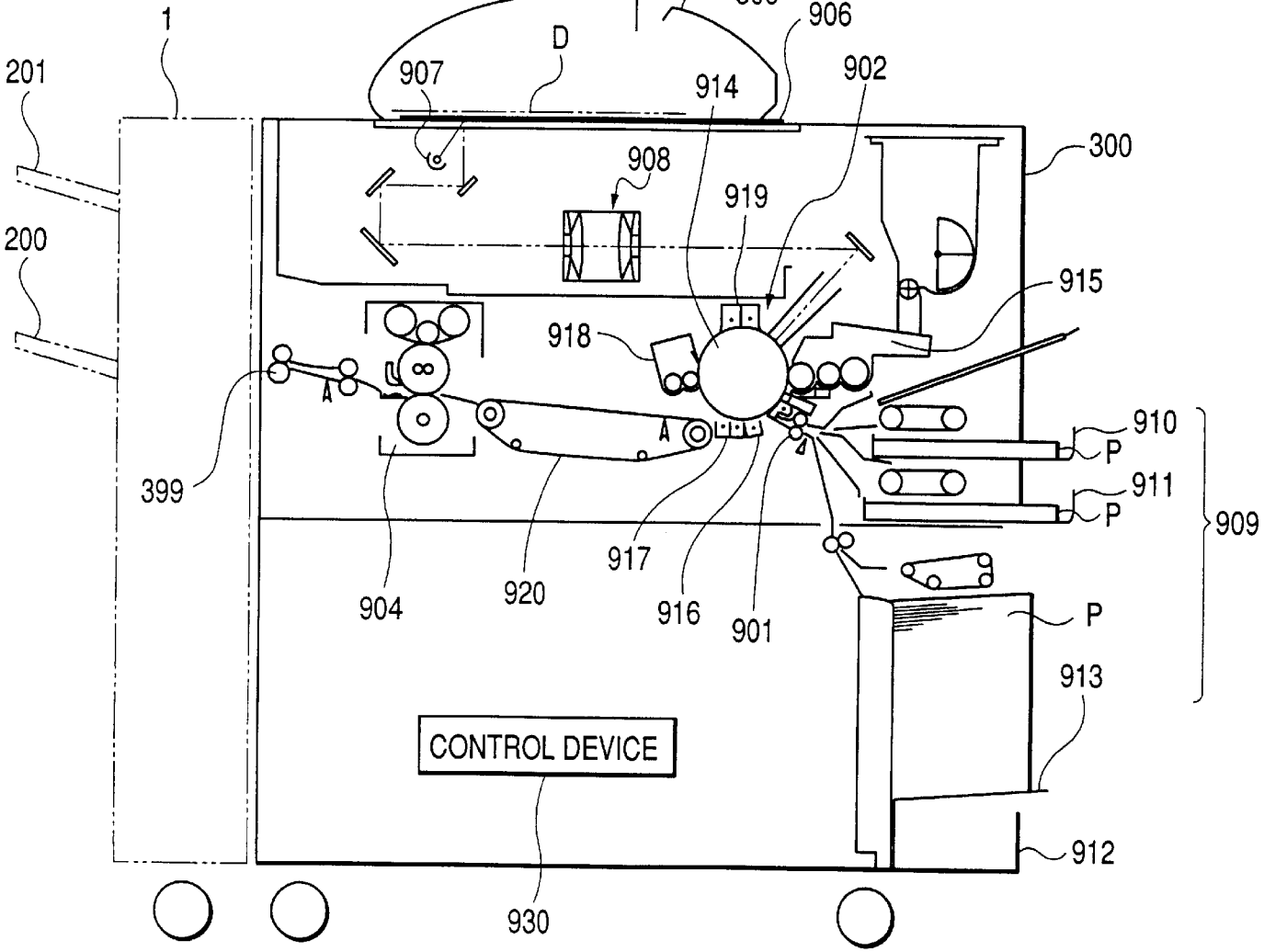
FIG. 21 is an elevation view of an image forming apparatus in which the sheet processing apparatus of the present invention is applicable.

FIG. 21 shows an example of the sheet processing apparatus of the present invention, and an image forming apparatus provided with such sheet processing apparatus. The image forming apparatus shown therein is a copying apparatus with an automatic original feeding device.

The image forming apparatus shown in FIG. 21 is comprised of a main body 300 of the apparatus, an automatic original feeding device 500, and a sheet processing apparatus 1.

The main body 300 of the image forming apparatus (hereinafter simply called "main body") is provided with a platen glass 906 serving as an original supporting table a light source 906, a lens system 908, a sheet feeding unit 909, and an image forming unit 902, and, on the main body 300, there are mounted a RDF (recycling document feeder) for feeding an original document D to the platen glass 906, and the sheet processing apparatus 1 for stacking sheets P already subjected to image formation and discharged from the main body 300.

The sheet feeding unit 909 is provided with cassettes 910, 911 housing sheets P such as recording paper and detachably mounted on the main body 300, and a deck 913 provided on a pedestal 912. The image forming unit 902 is provided with a cylindrical photosensitive drum 914, and a developing unit 915, a transfer charger 916, a separating charger 917, a cleaning unit 918 and a primary charger 919 provided therearound. At the downstream side of the image forming unit 902, there are provided a conveyor unit 920, a fixing unit 904, paired discharge rollers 399, etc. There are also provided a stacking tray 200 (to be explained later) on which the sheet P is discharged, and a sample tray 201 (also to be explained later).

In the following there will be explained the function of the above-described main body 300 of the apparatus.

When a sheet feed signal is outputted from a control device (control means) 930 provided on the main body 300, a sheet P is supplied from the cassette 910 or 911 or the deck 913. On the other hand, the original document D placed on a platen glass 906 is illuminated by the light source 907, and the light reflected therefrom irradiates the surface of the photosensitive drum 914 through the lens system 908. The surface of the photosensitive drum 914 is uniformly charged in advance by the primary charger 919, and an electrostatic latent image is formed by light irradiation and is then developed by toner deposition in the developing unit 915 to form a toner image.

The sheet P supplied from the sheet feeding unit 909 is subjected to correction of skewing and timing adjustment by registration roller 901, and is supplied to the image forming unit 902. In the image forming unit 902, the toner image on the photosensitive drum 914 is transferred by the transfer charger 916 onto the supplied sheet P, which is then charged by a separation charger 917 in a polarity opposite to that of the transfer charger 916 and is thus separated from the photosensitive drum 914.

The separated sheet P is transported by the conveyor unit 920 to the fixing unit 904, and is subjected to heat and pressure therein whereby the toner image is permanently fixed on the surface. The sheet P bearing the fixed image is discharged by the paired discharge rollers 399 from the main body 300.

Subsequently, the sheet P is discharged to the sheet processing apparatus 1 provided with a sheet punching unit 50, a stapling unit 100 (to be explained later) etc.

In the following, there will be given an explanation on the sheet processing apparatus (finisher) 1 of the present invention, with reference to the attached drawings. Detailed explanation on the main body 300 and the RDF 500 will be omitted.

Figure 1:
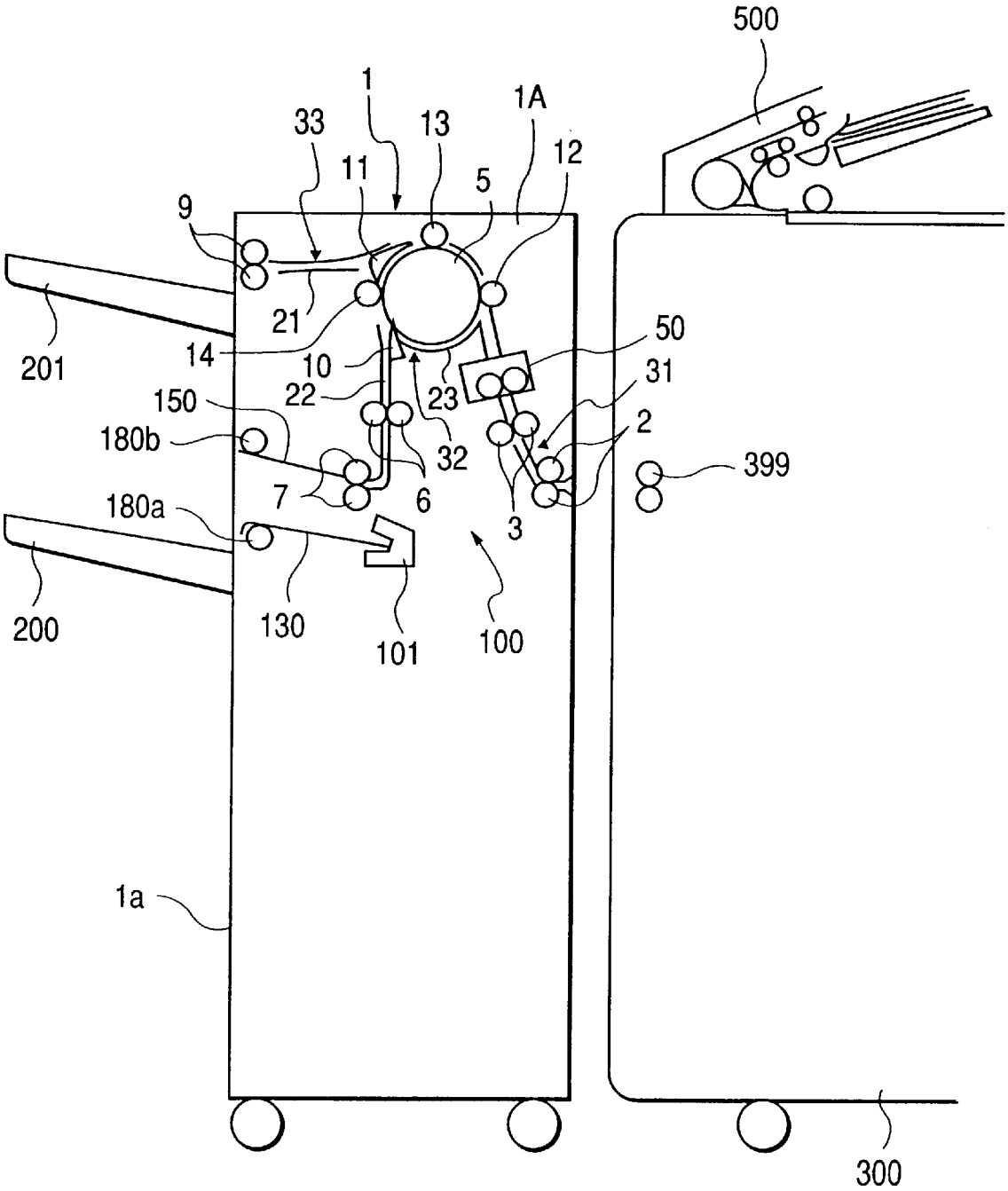
FIG. 1 is an elevation view showing the entire configuration of a sheet processing apparatus of the present invention.

Referring to FIG. 1, there are shown paired discharge rollers 399 provided on the main body 300, entrance rollers 2 provided in the sheet processing apparatus, transport rollers 3, a sheet sensor 31, a punch unit (sheet punching device) 50 for punching holes in the vicinity of the rear end of the transported sheet P, and a large transport roller 5 for transporting the sheet P in cooperation with pressure rollers 12, 13 and 14.

A switching flapper 11 switches the destination of the sheet P to a non-sorting path 21 or a sorting path 22. A switching flapper 10 switches the destination of the sheet P to the sorting path 22 or a buffer path 23 for temporarily storing the sheet P. There are also provided transport rollers 6, a processing tray 130 for temporarily stacking, aligning and stapling the sheets P, discharge rollers 7 for discharging the sheet P onto the processing tray 130, a rocking guide 150, and a bundle discharging upper roller 180*b* supported by the rocking guide 150 and adapted, when the rocking guide 150 reaches a closed position, to transport and discharge a bundle of the sheets P from the processing tray 130 to the stacking tray 200 in cooperation with a bundle discharging lower roller 180*a*.

Figure 3:
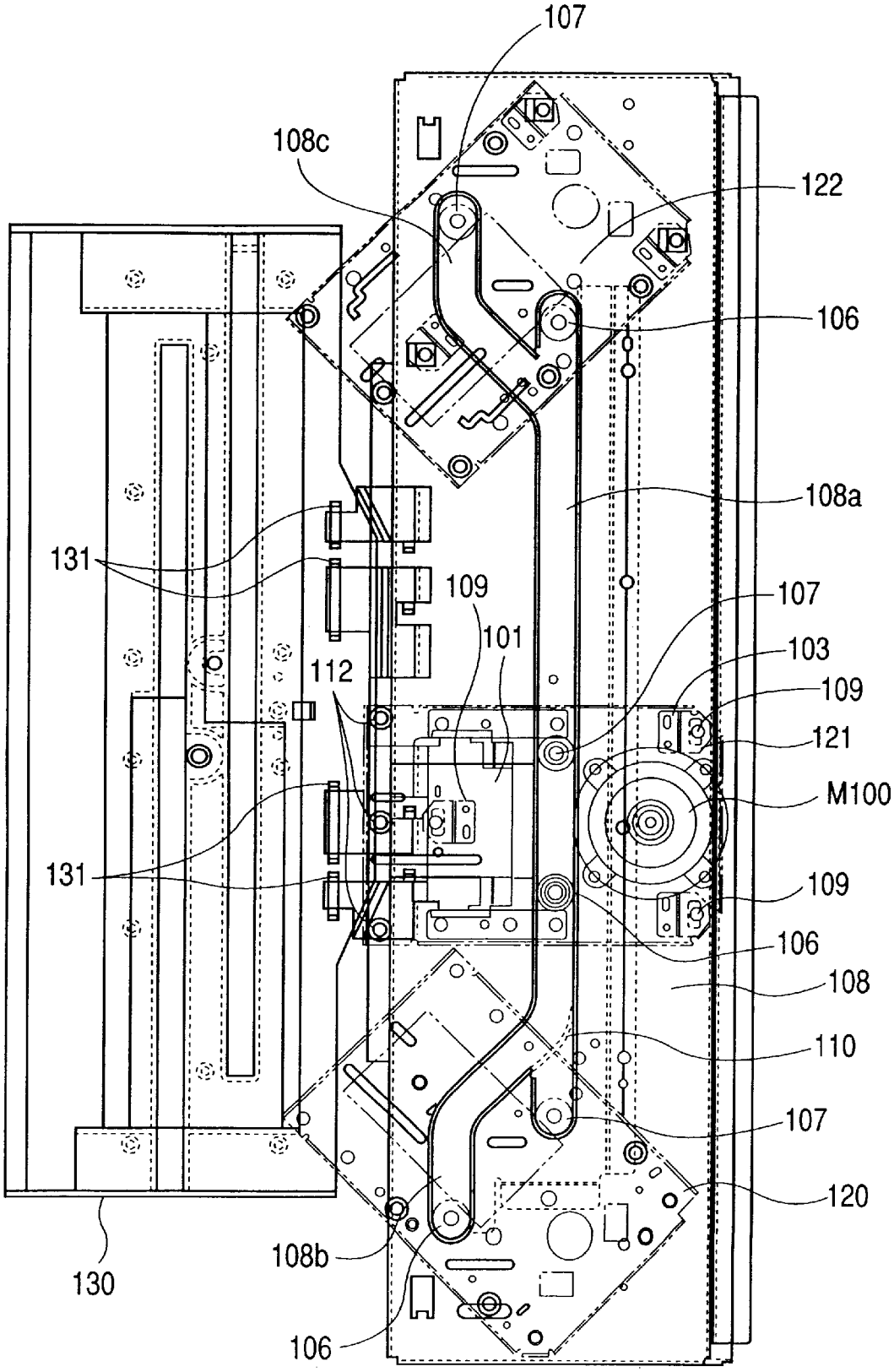
FIG. 3 is a plan view of a stapler moving mechanism, seen from a direction a shown in FIG. 2.
Figure 4:
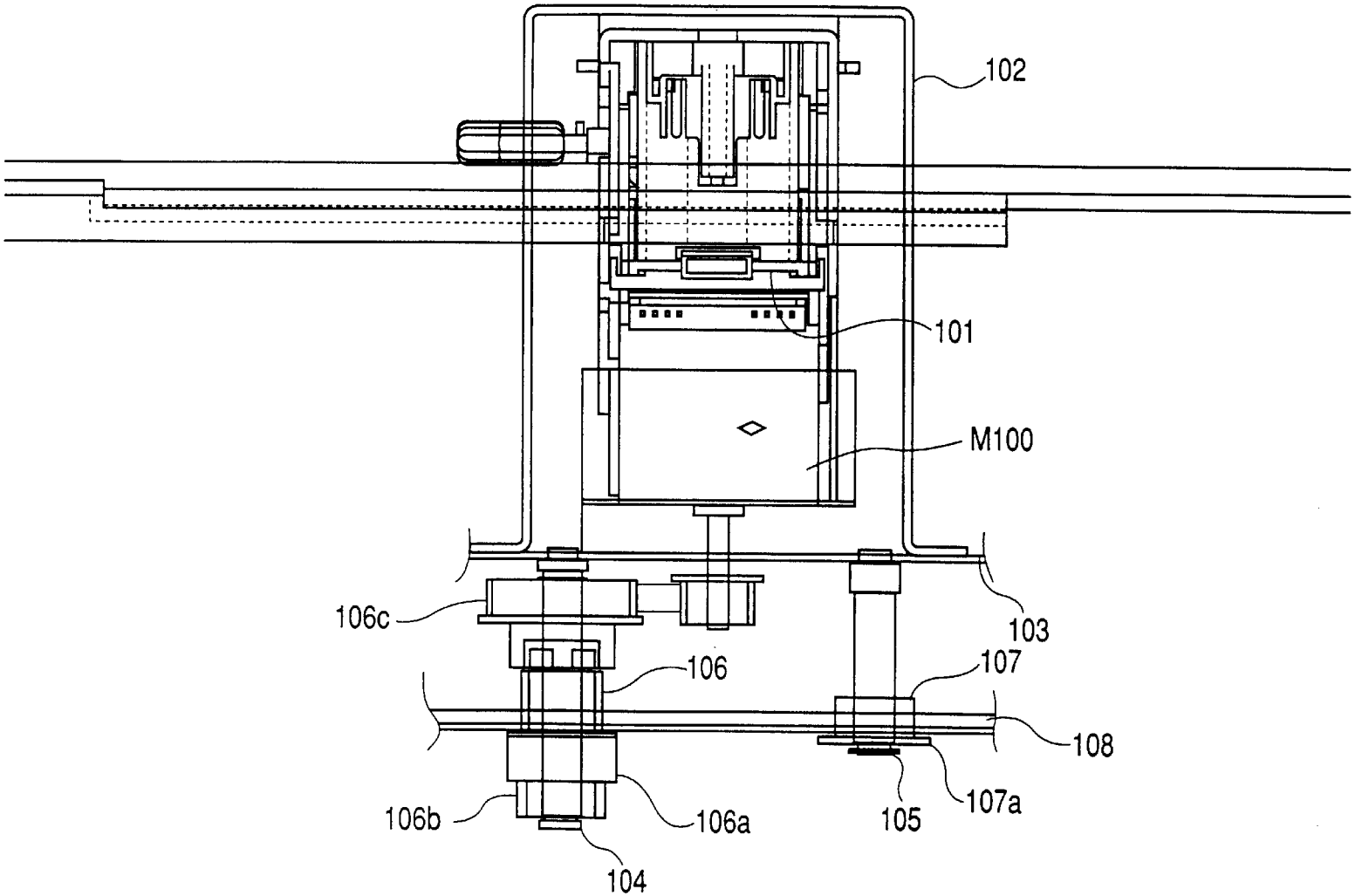
FIG. 4 is a rear view of the stapler, seen from a direction b shown in FIG. 2.

In the following there will be explained the stapling unit 100 with reference to FIGS. 2 to 4.

A stapler 101, which is one of the main constituents of the stapling unit 100, is fixed by a holder 102 to a movable table 103. Shafts 104, 105 fixed to the movable table 103 respectively and rotatably support rollers 106, 107 which are fitted in hole-shaped rail apertures 108*a*, 108*b* and 108*c* provided in a fixed table 108.

The rollers 106, 107 are provided with flanges 106*a*, 107*a* of a diameter larger than the width of the rail of the fixed table 108. Under the movable table 103, supporting rollers 112 are provided in three positions, whereby the movable table 103 supporting the stapler 101 can move on the fixed table along the rail apertures 108*a*, 108*b* and 108*c*. The movable table 103 moves on the fixed table 108 by a roller 109 rotatably provided on the movable table 103.

The above-mentioned rail apertures 108*a*, 108*b* and 108*c* are branched in the front portion (lower part in FIG. 3) and in the rear portion (upper part in FIG. 3) to constitute two parallel rail apertures. Because of such shape of the rails, when the stapler 101 is positioned in front a roller 106 engages with the rail aperture 108*b* while the other roller 107 engages with the rail aperture 108*a* whereby the stapler 101 becomes inclined. When the stapler 101 is positioned at the center, the both rollers 106, 107 engage with the rail aperture 108*a* whereby the stapler 101 becomes horizontal.

When the stapler 101 is positioned at rear, the roller 106 engages with the rail aperture 108*a* while the other roller 107 engages with the rail aperture 108*c* opposite to the state when the stapler is positioned in front, whereby the stapler 101 is inclined in a direction opposite to the state when the stapler is positioned in front.

After the two rollers 106, 107 respectively engage with the two parallel rail apertures, namely rail apertures 108*a* and 108*b*, or 108*a* and 108*c*, the rollers move maintaining the inclined position. The change of moving direction is stared by a cam (not shown).

In the following, there will be explained a moving mechanism for the stapler 101.

A roller 106 of the above-described movable table 103 is integrally provided with a pinion gear 106*b* and a belt pulley 106*c*, and the pinion gear 106*b* is coupled, through a belt on the pulley 106*c*, with a motor M100 fixed on the movable table 103. On the other hand, on the lower face of the fixed table 108, a rack gear 110 meshing with the pinion gear 106*b* is fixed along the rail aperture 108*a*, whereby, by the forward or reverse rotation of the motor M100, the movable table 103 is moved front and back (upward or downward in FIG. 3) together with the stapler 101.

A shaft 111 extending downward from the movable table 103 supports a stopper felling roller 112, for rotating a rear end stopper 131 of the processing tray 130 in order to prevent collision of the rear end stopper 131 with the stapler 101, as will be explained in more detail.

The stapler unit 100 is provided with a sensor for detecting the home position of the stapler 101, which thus waits, in the normal state, in the home position (frontmost part in the present embodiment).

In the following there will be given an explanation on the rear end stopper 131 supporting the rear end of the sheets P stacked on the processing tray 130.

The rear end stopper 131 is perpendicular to the stacking face of the processing tray 130, and is provided with a support face 131*a* for supporting the rear end of the sheets, a pin 131*b* engaging with a round hole provided in the processing tray 130 and adapted to perform a rocking motion, and a pin 131*c* for engaging with a link to be explained later. The link is comprised of a main link 132 having a cam face 132*a* to be impinged and pressed by a roller 112 assembled on the movable table 130 of the stapler, and a connection link 133 which connects a pin 132*b* provided at the upper end of the main link 132 with a pin 131*c* of the rear end stopper 131.

Figure 2:
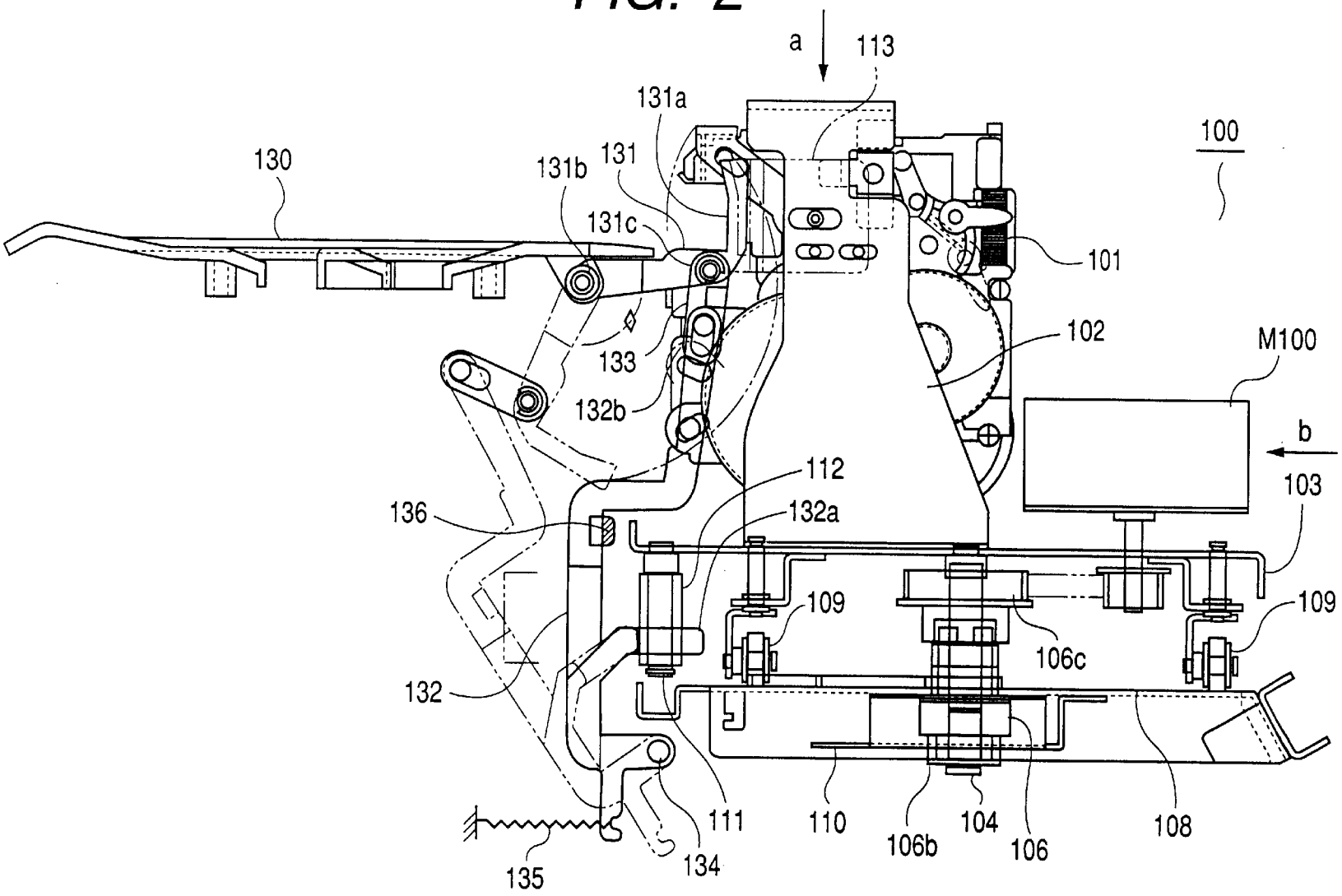
FIG. 2 is a lateral view of a stapler and a processing tray unit.

The main link 132 is adapted to perform a rocking motion about a shaft 134 fixed to a frame (not shown), and is provided, at the lower end, with a tensile spring 135 for biasing the main link 132 in the clockwise direction in FIG. 2. As the main link 132 is positioned by an impinging plate 136, the rear end stopper normally maintains a position perpendicular to the processing tray 130.

When the movable table 103 moves, the felling roller 112 provided thereon pushes the cam face 132*a* of the main link 132 connected with the rear end stopper 131 which is in an interfering position with the stapler 101, whereby the rear end stopper 101 is pulled by the connection link 133 and is rotated to a position not interfering with the stapler 101. The felling roller 112 is provided in plural units (three in the present embodiment), in order that the rear end stopper 131 maintains the rotated position during the movement of the stapler 101.

On both lateral faces of the holder 103 supporting the stapler 101 there are provided stapler stopper 113 (indicated by double-dotted chain lines) having a support face same as that of the rear end stopper 131, whereby the rear end of the sheets can be supported by the stapler stopper 113 even while the stapler 101 is in the horizontal state (at the center) and is pushing the rear end stopper 131.

In the following, there will be explained a processing tray unit 129, with reference to FIGS. 5 and 6.

The processing tray unit 129 is provided between a transport unit for transporting the sheet P from the main body 300 and the stacking tray 200 for receiving and holding the bundle processed in the processing tray 130, and is comprised of a processing tray 130, a rear end stopper 131, aligning means 140, a rocking guide 150, a retractable puddle 160 (hereinafter simply called "puddle"), a submerging tray 170 and paired bundle discharging rollers 180.

The processing tray 130 is an inclined tray, positioned higher at the downstream side (left side in FIG. 5) and lower at the upstream side (right side in FIG. 5), and the aforementioned rear end stopper 131 engages with the lower end. The sheet P discharged by the discharge rollers 7 of the transport unit slides, by the weight thereof and by the function of the puddle 160, on the processing tray 130 until the rear end of the sheet P impinges on the rear end stopper 130. The upper end of the processing tray 130 is provided with the bundle discharging lower roller 180*a* while the rocking guide 150 to be explained later is provided with the bundle discharging upper roller 180*b* which comes into contact with the lower roller 180*a*, and these rollers can rotate in the forward and reverse directions by a motor M180.

Figure 6:
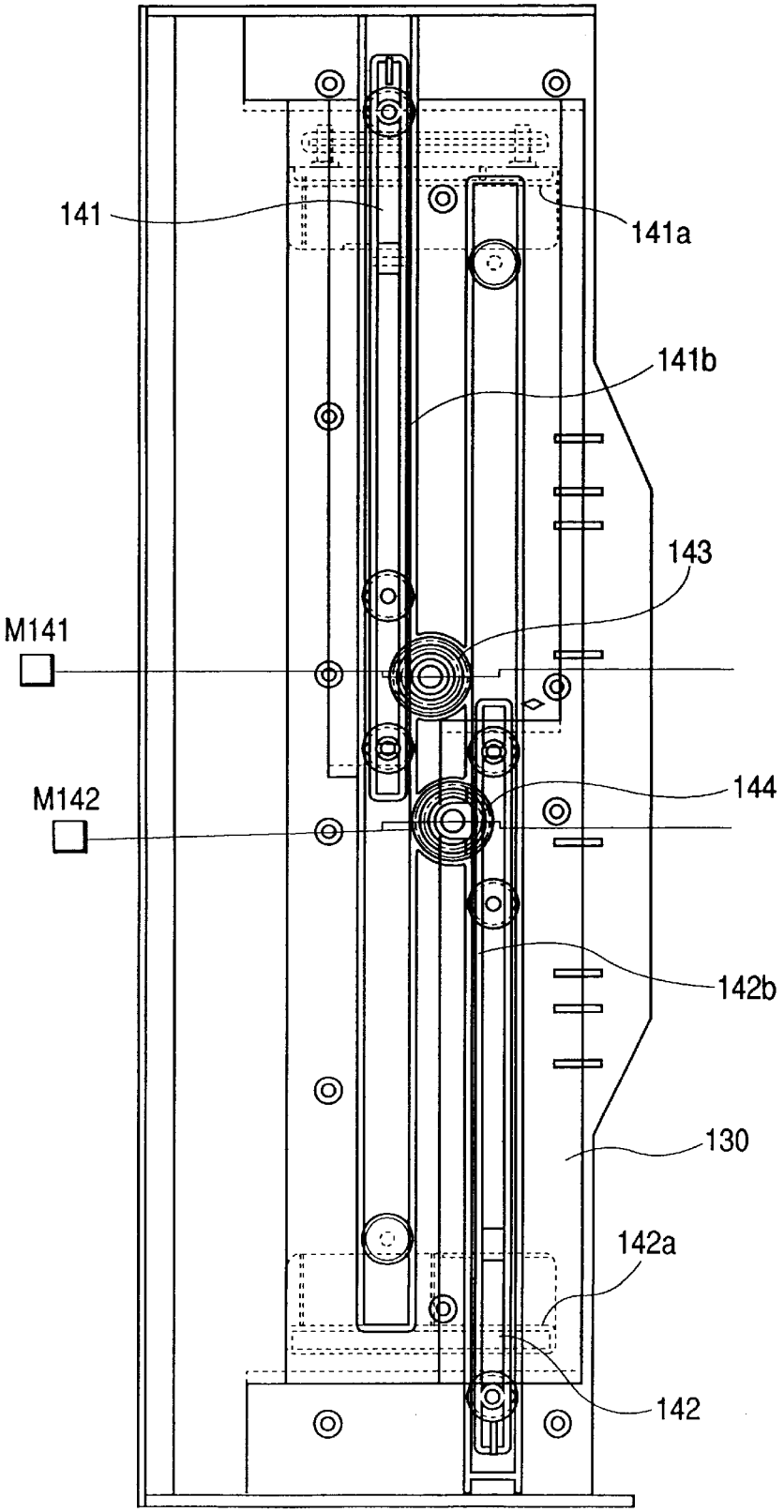
FIG. 6 is a plan view of the processing tray and an aligning wall moving mechanism.

In the following, there will be given an explanation on the aligning means 140 with reference to FIG. 6 showing a view seen from a direction c.

Aligning members (walls) 141, 142 constituting the aligning means are respectively provided at the front side and at the rear side, and are rendered independently movable front and back. The aligning member 141 in front and the aligning member 142 at rear are comprised of aligning faces 141*a*, 142*a* standing perpendicularly on the processing tray 130 and pressing the lateral ends of the sheets, support faces perpendicularly extending from the aligning faces and supporting the lower face of the sheets P, and gear portions 141*b*, 142*b* extending parallel to the processing tray 130 and having rack gears. The two aligning members 141, 142 are respectively supported by a guide opened in the longitudinal direction of the processing tray 130 and the guide is so assembled that the aligning faces are positioned on the processing tray 130 and the gear portions protrude thereunder.

The rack gear portions 141*b*, 142*b* respectively mesh with pinion gears 143, 144 which are linked through pulley and belts with motors M141, M142 whereby the aligning members 141, 142 are moved front and back by the forward and reverse rotation of these motors M141, M142. The aligning members 141, 142 are provided with sensors (not shown) for detecting home positions, and normally wait in the home positions, based on the detection by these sensors. In the present example, the home position of the aligning member 141 in front is at the frontmost position, while that of the aligning member 142 at rear is at the rearmost position.

In the following, there will be explained the rocking guide 150.

Figure 5:
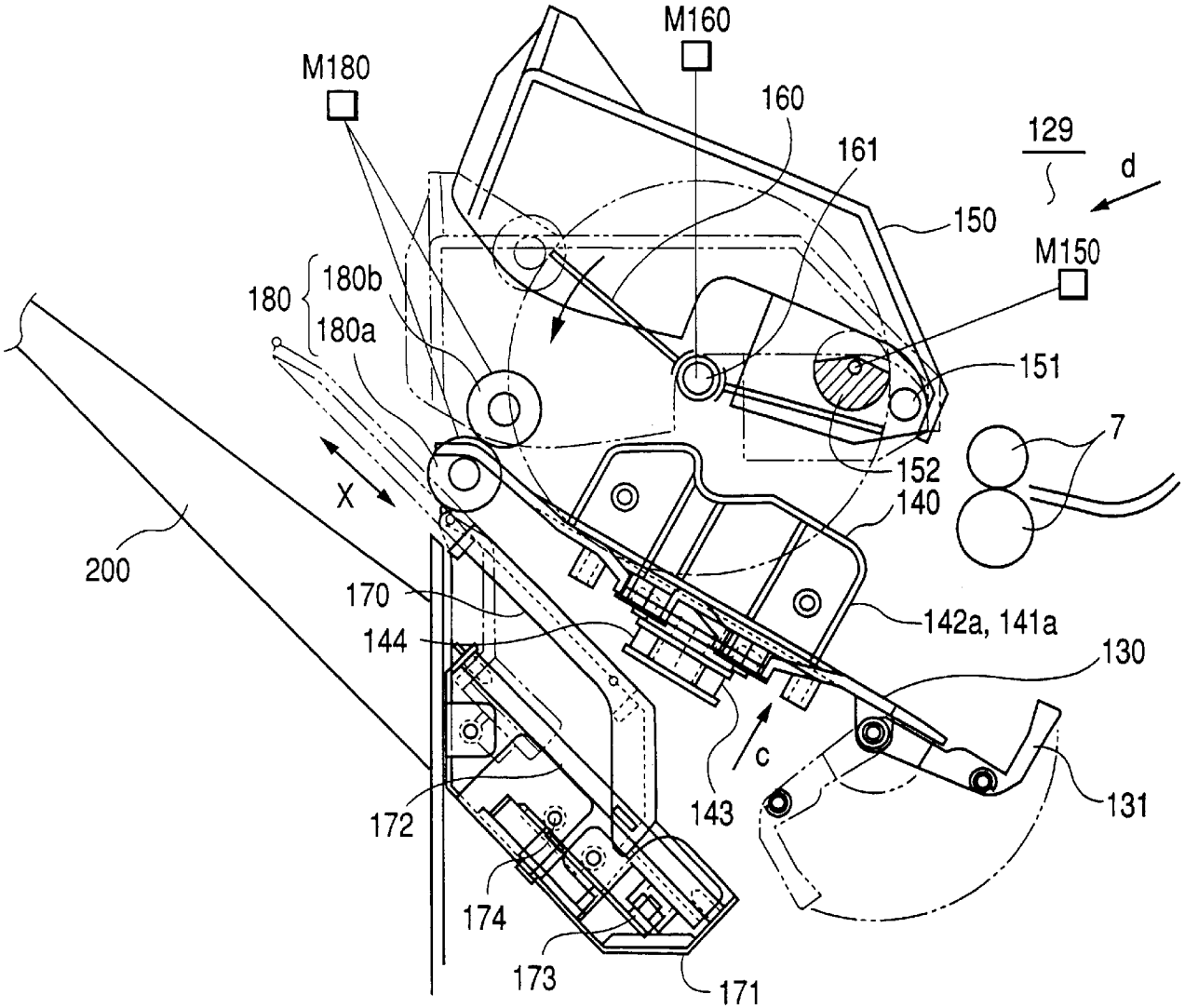
FIG. 5 is a lateral cross-sectional view of a rocking guide and a processing tray.

The rocking guide 150 supports the aforementioned bundle discharging upper roller 180*b* at the downstream side (left side in FIG. 5), and is provided with a rocking shaft 151 at the upstream side (right side in FIG. 5). When the sheets P are discharged one by one onto the processing tray 130, the rocking guide 150 is in an open state (in which the paired bundle discharging rollers 180 are separated), whereby the sheets P can be discharged, dropped onto the processing tray 130 and be aligned without hindrance, but, it is shifted to a closed state (in which the paired bundle discharging rollers 180 are in mutual contact) at the discharge of a bundle from the processing tray 130 to the stacking tray 200.

A rotary cam 152 is provided at a position corresponding to the lateral face of the rocking guide 150, when the rotary cam 152 is rotated to push up the lateral face of the rocking guide, it performs a rocking motion about a shaft 151 and reaches the open state. When the rotary cam 152 is rotated by 180° from this position and is separated from the lateral face of the rocking guide, it reaches the closed state. The rotation of the rotary cam 152 is executed by a motor M150 connected through an unrepresented drive system.

The open state of the rocking guide 150 is defined as the home position thereof, and there is provided a sensor (not shown) for detecting such state.

In the following, there will be explained the retractable puddle 160.

The retractable puddle 160 is fixed to a puddle shaft 161 rotatably supported by front and rear lateral plates. The puddle shaft 161 is linked to a motor M160 and is rotated, counterclockwise in FIG. 5, by the motor M160. The retractable puddle 160 is made slightly longer than the distance to the processing tray 130, and is located, at the home position thereof, in a position (solid-lined position) not coming into contact with the sheet P discharged from the discharge rollers 7 to the processing tray 130. When the sheet P is discharged in this state and lands on the processing tray 130, the retractable puddle 160 rotates counterclockwise by the motor M160 and is retracted until the sheet P impinges on the rear end stopper 131. Subsequently, after a predetermined waiting time, the retractable puddle 160 stops at the home position in preparation for the discharge or a next sheet P.

Figure 7:
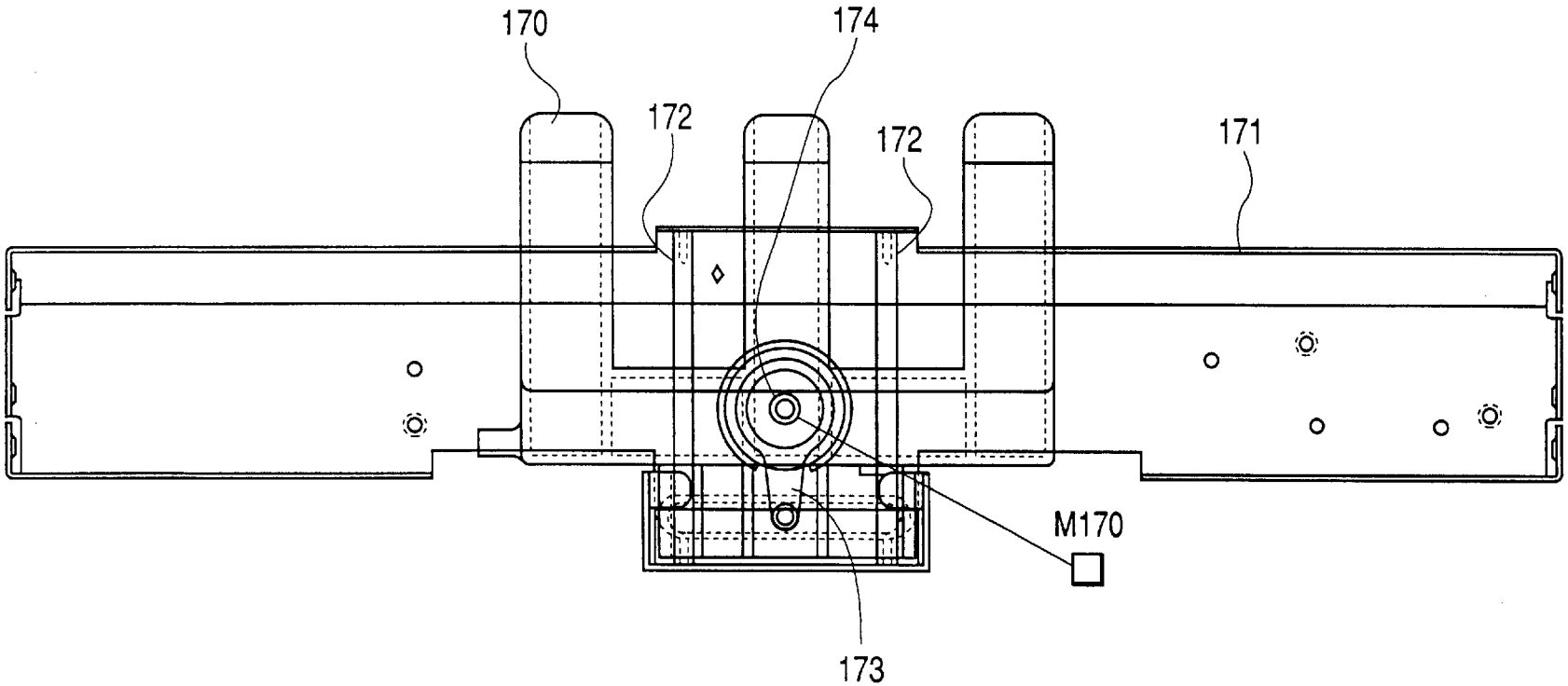
FIG. 7 is a plan view of a submerging tray.

In the following, there will be explained the submerging tray 170, with reference to FIG. 5 and FIG. 7 showing a view seen from a direction d in FIG. 5.

The submerging tray 170 is positioned below the bundle discharging lower roller 180*a* and moves in the sheet transporting direction (x direction), substantially parallel to the inclination of the processing tray 130. In the protruding state of the submerging tray 170, the front end protrudes toward the stacking tray 200 (as indicated by two-dotted chain lines in FIG. 5), and, in the retracted state, the front end is retracted to the right of the paired bundle discharging rollers 180 (as indicated by solid lines). The front end position in the protruding state is so selected that the center of gravity of the sheet P discharged on the processing tray 130 does not pass through the front end.

The submerging tray 170 is supported by two rails 172 fixed on a frame 171, and is rendered movable in the sheet discharging direction. As a rotary link 173 rotatable about a shaft 174 engages with a groove provided on the lower face of the submerging tray 170, the tray performs the advancing and retracting motions mentioned above by a turn of the rotary link 173. The rotary link 173 is driven by a motor M170 through a drive mechanism (not shown). The home position of the submerging tray 170 is selected at the retracted position (solid-lined position in FIG. 5), and such home position is detected by a sensor (not shown).

In the following, there will be explained the stacking tray (sheet stacking means) 200 and the sample tray (sheet stacking means) 201, with reference to FIGS. 8 and 9. These trays may be collectively called "trays 200, 201".

These two trays 200, 201 are selectively used according to the situation. More specifically, the lower stacking tray 200 is selected in receiving an output of copying or an output of printer, while the upper sample tray 201 is selected in receiving a sample output, an interruption output, an output overflowing from the stacking tray, an output of functional sorting, an output of mixed jobs etc.

The two trays 200, 201 are respectively provided with motors 202 so as to be independently movable in the vertical direction, and each tray is mounted on a rack 210 which also functions as a roller receiver and is mounted vertically on a frame 250 of the apparatus 1. A limiting member 215 is provided to limit the plays in front and at rear of the trays. In each of the trays 200, 201, the stepping motor 202 is mounted on a tray base plate 211, and a pulley fixed on the motor shaft transmits the driving force to a pulley 203 through a timing belt 212.

A shaft 213 connected to the pulley 203 with parallel pins transmits the driving force to a ratchet 205 similarly connected to the pulley 203 with parallel pins and the ratchet 205 causes a spring 206 to bias an idler gear 204. The idler gear 204 transmits the driving force to a gear 209, which in turn transmits the driving force to the gear 209. The gear 207 is provided in two units, on both ends of a shaft 208, in order to drive the trays 200, 201 at the front and rear sides, and the two gears 207 are linked to the racks 210 through the gears 209. The trays 200, 201 constitute a tray unit, together with the motors 202, idler gears 204, a base plate 211 supporting these members, a sheet support plate (not shown) mounted on the base plate 211 etc.

In order to prevent damage to the tray driving system from the riding on an unexpected article at the descent of the trays, the above-mentioned ratchet 205 is rendered capable of idle rotation against the function of the spring 206, only in a direction lifting the trays 200, 201. In order to immediately stop the motors 202 in case of such idle rotation, a sensor S201 detects a slit provided on the idler gear 204. In the ordinary state, this sensor S201 is also used for detecting a disorder in the synchronization. The rocking guide constitutes a part of the stacking walls of the trays 200, 201 in the closed state thereof so as to vertically cross the aperture of the processing tray 130, and is rendered movable only when the closed state is detected by a sensor (not shown).

An area detecting sensor S202 (FIG. 8) detects a flag in an area from an upper limit sensor S203*a* (FIG. 9) for stopping excessive ascent of the trays 200, 201 to a sheet surface sensor (lower limit detection means) S203*e* of the stacking tray. A 1000 sheet position sensor S203*b* of the sample tray is provided at a distance corresponding to 1000 sheets from the non-sort sheet surface sensor (upper surface detection means) S204 in order to limit the stacking height on the sample tray 201.

A sensor S203*c* is provided for limiting the stacking height when the sample tray 201 receives the sheets P from the processing tray 130 and is also located at a position corresponding to 1000 sheets from the sheet surface sensor S205. A sensor S203*d* is provided for limiting the stacking height when the stacking tray 200 receives the sheets P from the processing tray 130 and is located at a position corresponding to 1000 sheets from the sheet surface sensor S205. A sensor S203*e* is provided for preventing excessive descent of the stacking tray 200. Among these, the sheet surface sensors S204, S205 only are comprised of transmissive sensors having optical axes in the front-rear direction. Also the trays 200, 201 are provided with sensors S206 for detecting the presence/absence of the sheet P.

The sheet surface is detected in the following manner. An initial state is defined by elevating the trays 200, 201 from below the sheet surface sensors S204, S205 until the stacked sheets P intercept the optical axes of the sensors S204, S205, and then lowering the trays 200, 201 until the optical axes are restored. Thereafter, as the sheets P are stacked, the trays are repeatedly lowered until the optical axis is restored.

In the following, there will be explained the flow of the sheets P when the non-storing mode is designated by the user.

Figure 10:
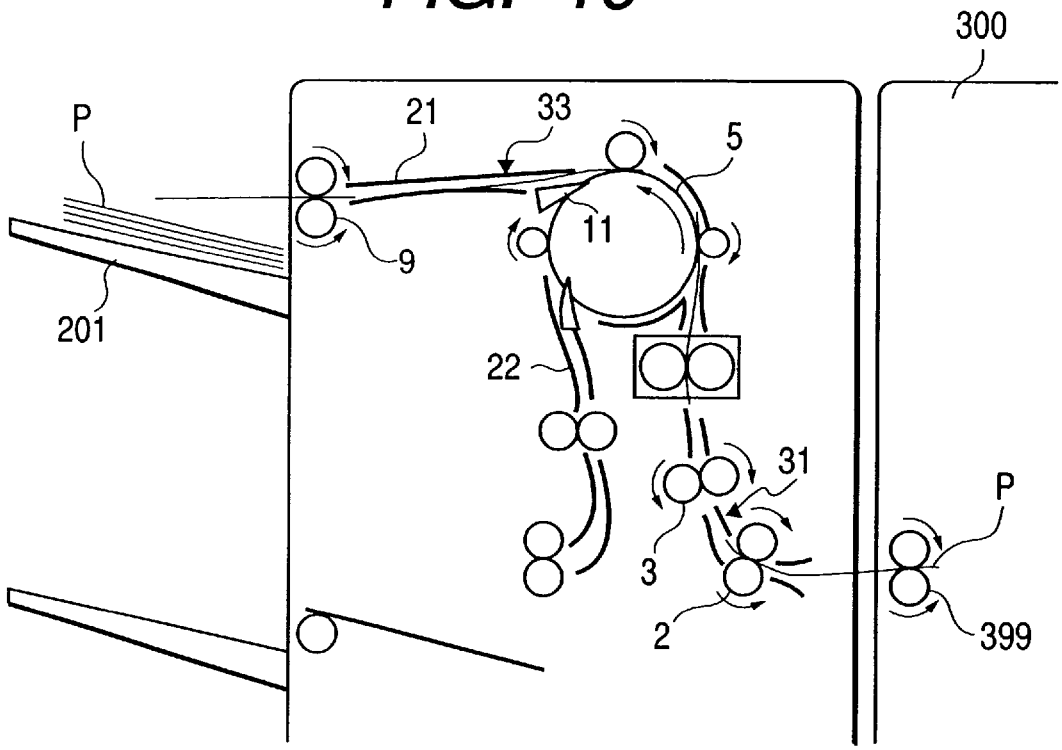
FIG. 10 is a view showing the function of the sheet processing apparatus in a non-sorting mode.

When the user selects the non-sorting mode by the operation unit (not shown) of the main body 300, the entrance rollers 2, transport rollers 3 and large transport roller 5 rotate to transport the sheet P discharged from the main body 300. The flapper 11 is shifted to a position shown in FIG. 10, by a solenoid (not shown), thereby guiding the sheet P to the non-sort path 21. When the sensor 33 detects the rear end of the sheet P, the discharge rollers 9 rotate at a speed suitable or stacking, thereby discharging the sheet P onto the sample tray 201.

In the following, there will be explained the flow of the sheets P when the stapling mode is designated by the user.

Figure 11:
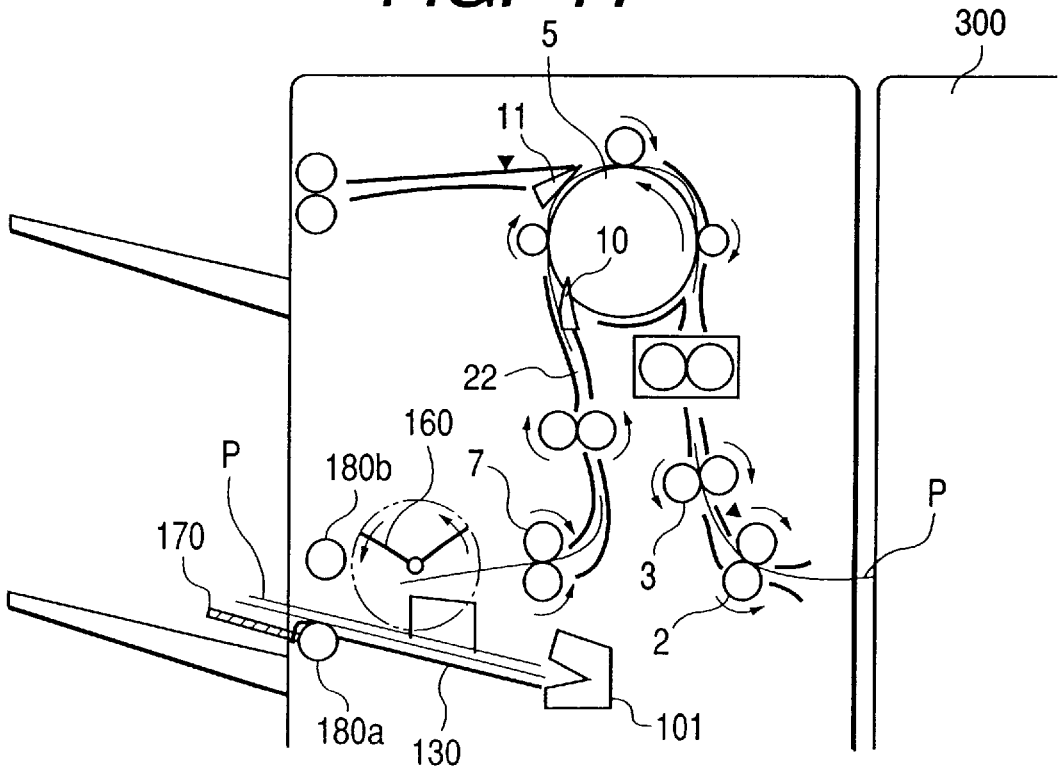
FIGS. 11, 12, 13, 14, 15, 16, 17, 18A and 18B are views showing the function of the sheet processing apparatus in a stapling-sorting mode.

As shown in FIG. 11, the entrance rollers 2, transport rollers 3 and large transport roller 5 rotate to transport the sheet P discharged from the main body 300. The flappers 10, 11 remain in the positions shown in FIG. 11. The sheet P passes the sorting path 22 and is discharged by the discharge rollers 8 onto the processing tray 130. The submerging tray 170 is in the protruding position to prevent hanging of the front end portion of the sheet P on the processing tray 130 and to improve sheet alignment thereon.

The discharged sheet P starts to move, by the weight thereof, toward the rear end stopper 131, and the retractable puddle 160 staying in the home position is rotated counterclockwise by the motor M160 to assist the movement of the sheet P on the processing tray 130. When the rear end of the sheet P is stopped by secure impingement on the rear end stopper 131, the rotation of the retractable puddle 160 is also stopped, and the aligning members 141, 142 align the discharged sheet P. The aligning operation for the sheets P will be explained later.

Figure 12:
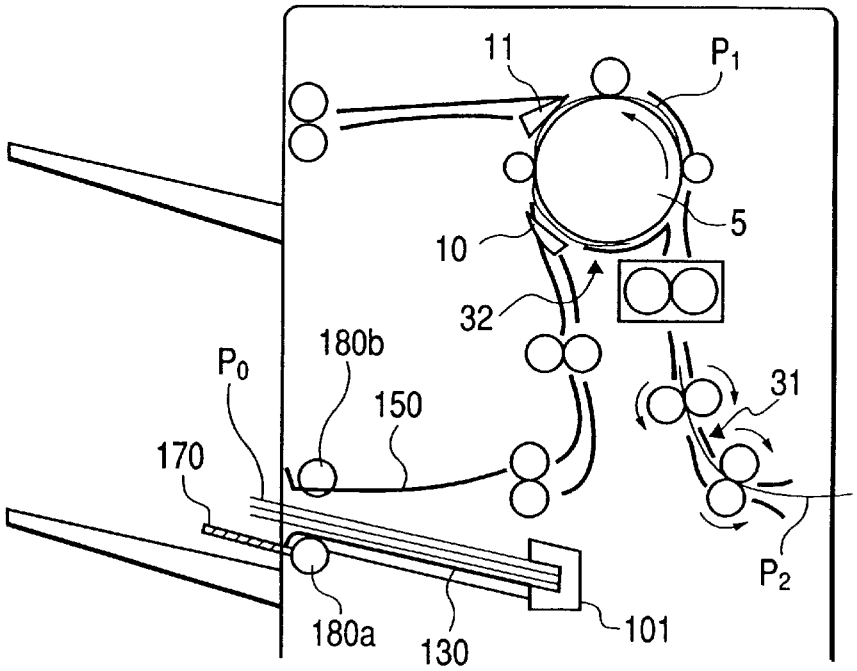

When all the sheets P constituting a first copy are discharged onto the processing tray 130 and aligned, the rocking guide 150 descends as shown in FIG. 12, then the bundle discharging upper roller 180*b* rides on the bundle and the stapler 101 staples the bundle of the sheets.

Figure 13:
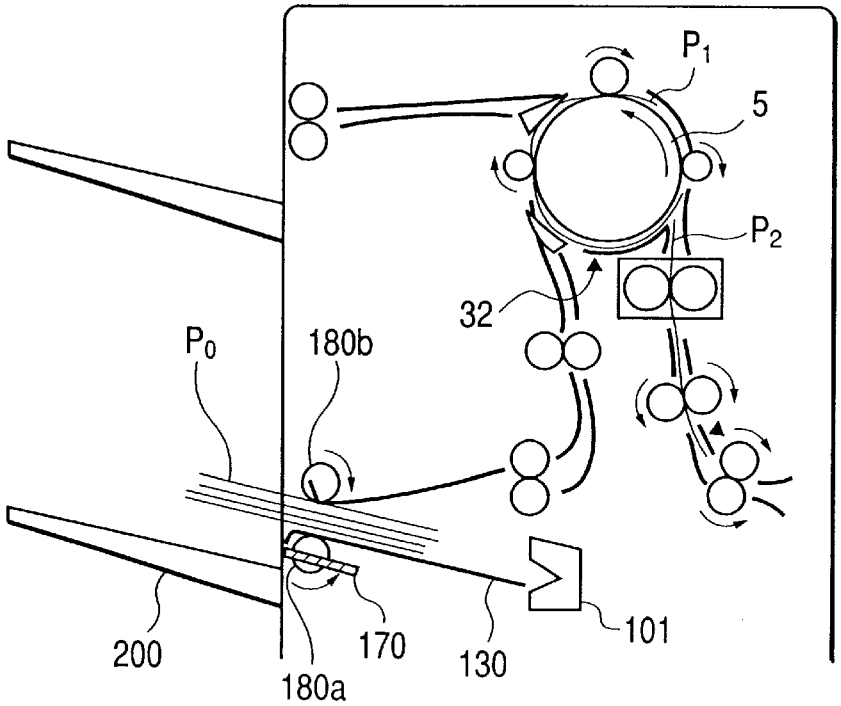
Figure 14:
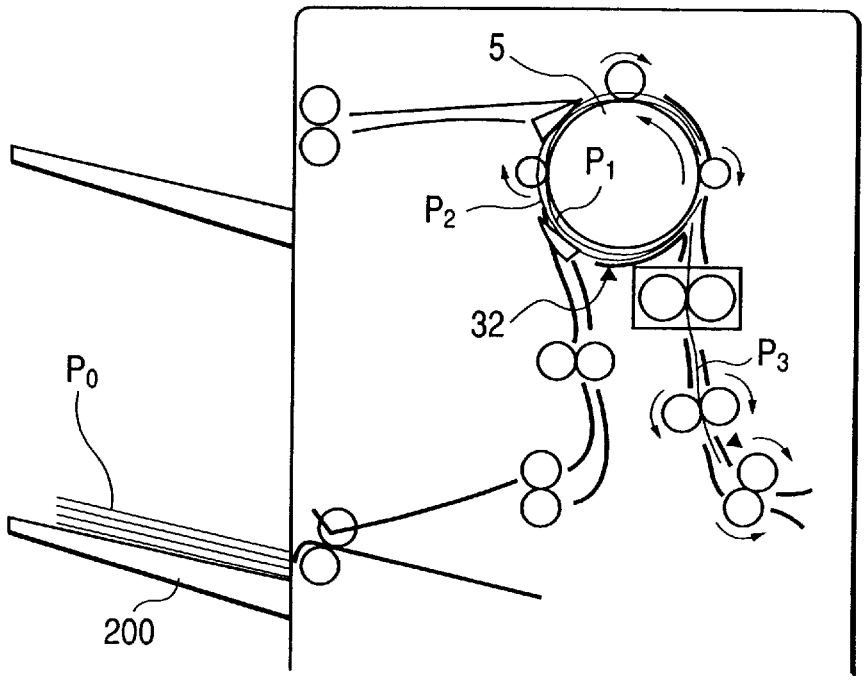

On the other hand, the sheet $P_1$ discharged from the main body 300 in the meantime is wound on the large transport roller 5 by the switching of the flapper 10, and stops after advancement by a predetermined distance from the sensor 32, as shown in FIG. 12. When a next sheet $P_2$ advances from the sheet sensor 32, the large transport roller 5 rotates as shown in FIG. 13 to overlay the sheets in such a manner that the second sheet $P_2$ precedes the first sheet $P_1$ by a predetermined distance, and the sheets are wound on the large transport roller 5 and stop at a predetermined distance. On the other hand, the sheet bundle on the processing tray 130 are discharged onto the stacking tray 200 as shown in FIG. 14.

Figure 15:
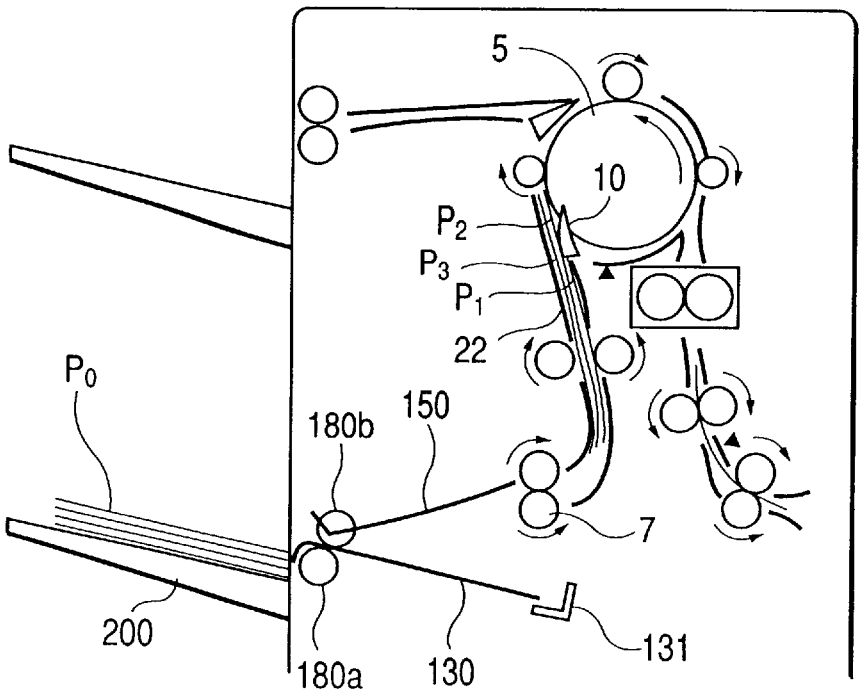

In this operation, in order to allow the sheet bundle to drop onto the stacking tray 200, the submerging tray 170 moves to the home position before the sheet bundle comes out of the paired bundle discharging rollers 180. Then, as shown in FIG. 14, when a third sheet $P_3$ reaches a predetermined position, the large transport roller 5 rotates to overlay the sheet $P_3$ with an offset by a predetermined amount, and the flapper 10 is switched as shown in FIG. 15 to transport the three sheets P to the sorting path 22.

Figure 16:
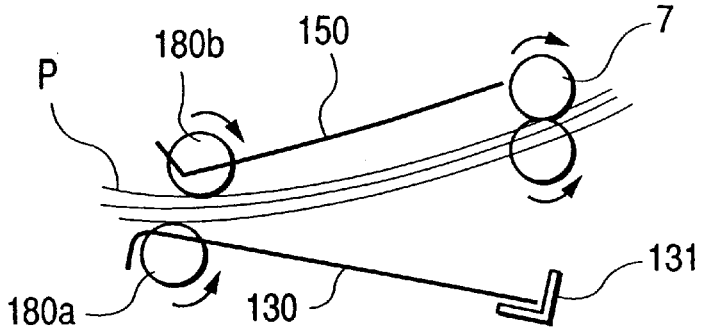
Figure 17:
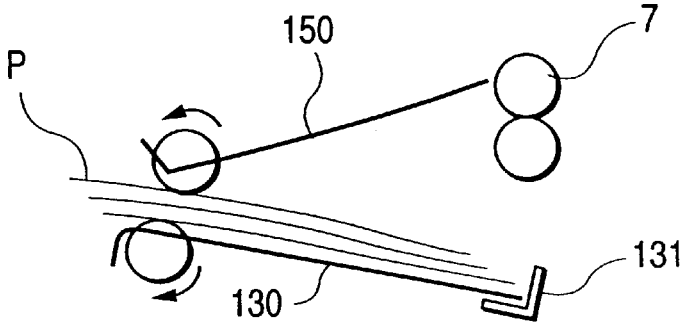
Figure 18A:
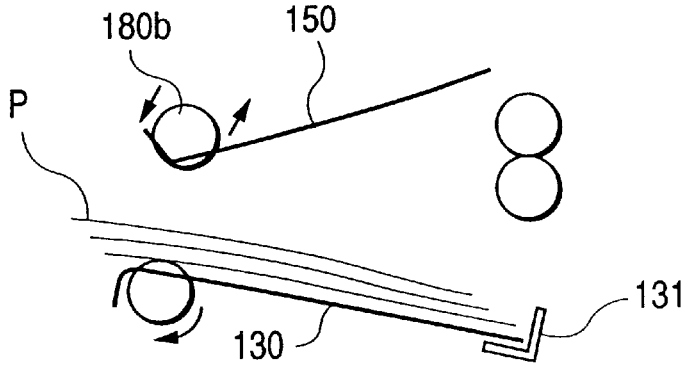

Then, as shown in FIG. 16, the bundle discharging lower and upper rollers 180*a*, 180*b* receive the three sheets P while the rocking guide is still in the lowered position. When the rear end of the sheets P comes out of the discharge rollers 7 as shown in FIG. 17, the bundle discharge rollers 180*a*, 180*b* are reversed, and, before the rear end of the sheets P impinges on the rear end stopper 131, the rocking guide 150 ascends as shown in FIG. 18A, and the bundle discharging upper roller 180*b* is separated from the sheet surface. The fourth and ensuing sheets P are discharged onto the processing tray 130 through the sorting path 22, as in the sheets of the first copy. The third and ensuing bundles are processed in the same manner as the second bundle, and the operation is terminated after a predetermined number of bundles of sheets are stacked on the stacking tray 200.

Figure 18B:
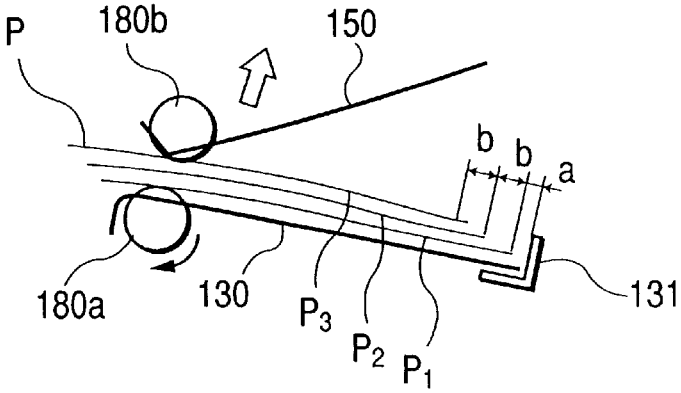

In the above-described overlaid transportation of the plural sheets P ($P_1$, $P_2$, $P_3$), they are mutually offset in the transporting direction. More specifically, the sheet $P_2$ is offset b an amount b (cf. FIG. 18B) in the downstream direction with respect to the sheet $P_1$, and the sheet $P_3$ is offset by the amount b in the downstream direction with respect to the sheet $P_2$.

The offset amount of the sheet P and the timing of ascent of the rocking guide 150 are related to the sitting time of the sheet P (time from the release of the sheet rear end from the rollers to the arrival at the rear end alignment means) which is dependent on the reversing speed of the bundle discharging upper roller 180*b*, and are therefore determined by the process ability of the main body 300. In the present embodiment, with a sheet transport speed of 750 mm/s, an offset amount b of about 20 mm and a reversing speed 500 mm/s of the bundle discharging rollers, the bundle discharging upper roller 180*b* is lifted up when the rear end of the sheet $P_1$ is positioned within 40 mm (corresponding to the value a) from the rear end stopper 131.

In the following, there will be explained the functions of the sorting mode.

Figure 19:
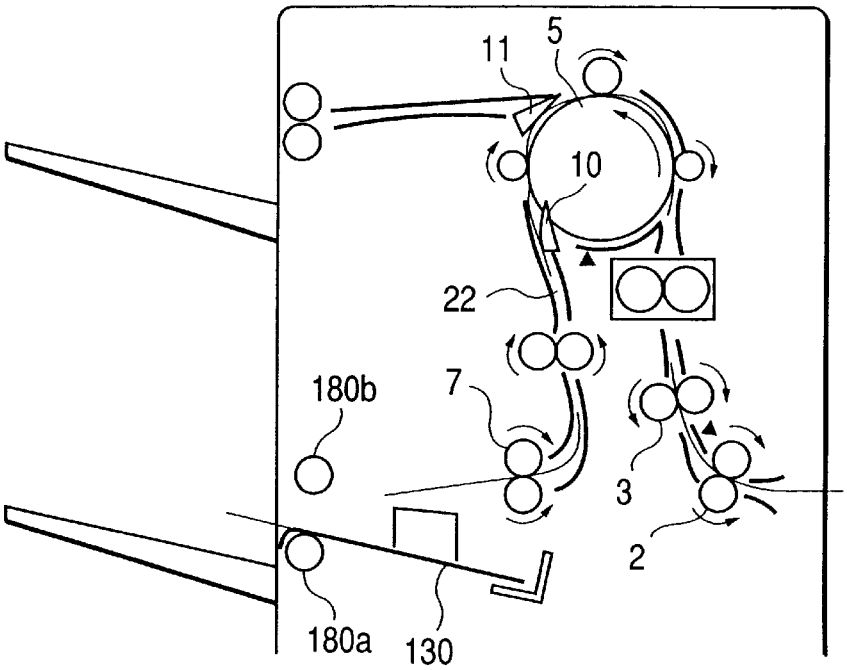
FIGS. 19 and 20 are views showing the function of the sheet processing apparatus in a sorting mode.
Figure 20:
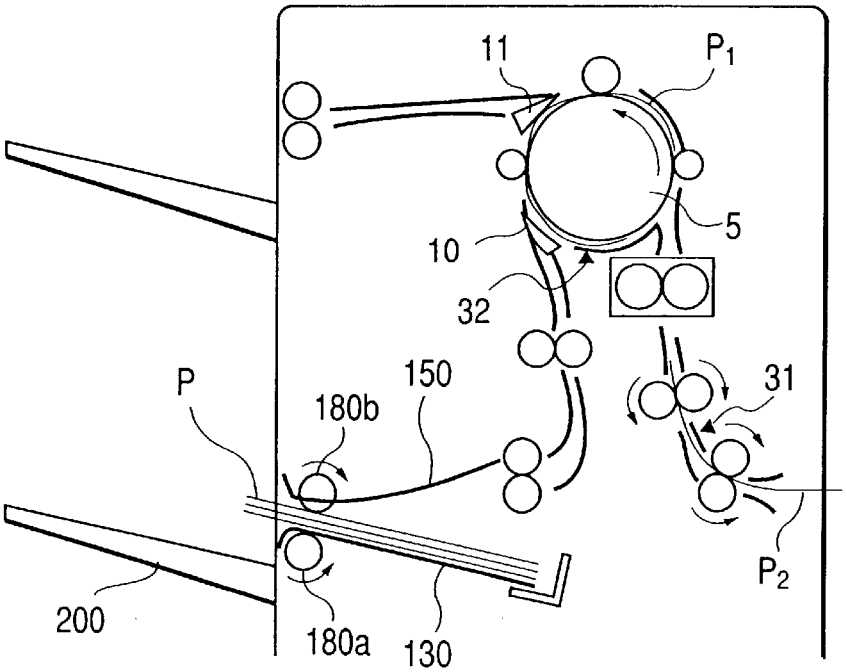

The user sets the original documents D on the RDF 500, then designates the sorting mode on the operation unit (not shown) and turns on a start key (not shown). The entrance rollers 2 and the transport rollers 3 rotate as shown in FIG. 19, as in the staple-sort mode, thereby stacking the sheets P on the processing tray 130. The alignment means 140 aligns the sheet P on the processing tray 130, and, after the stacking of a limited number of sheets, the rocking guide 150 descents as shown in FIG. 20 and transports the bundle of a limited number of sheets.

A next transported sheet P passes over the flapper 10, then wound on the large transport roller 5 as in the staple-sort mode, and is discharged onto the processing tray 130 after the sheet bundle has been discharged. Experimentally, the limited number of the sheet in the bundle is desirably 20 or less. This number is so selected as to satisfy the following relation:

$$\text{Number of originals} \geqq \text{Number of sheets in discharged bundle} \leqq 20$$

Thus, if the number of sheets in the discharged bundle is programmed as 5, and if the number of originals is 4, each discharged bundle contains 4 sheets. If the number of originals is larger than 5, for example 14, the sheets are divided as 5+5+4 and each divided bundle is aligned and discharged.

When all the bundles of the first copy are discharged, the front aligning member 141 is moved together with the rear aligning member 142, so that the alignment position for the second copy is offset with respect to that of the first copy.

The second copy is aligned in thus offset position, and is discharged in bundles of a limited number of sheets as in the first copy. After the second copy, the aligning members 141, 142 return to the aligning position for the first copy, and a third copy is aligned in this position. In this manner the bundles are discharged onto the stacking tray 200 with alternate offsetting to left and right transversally to the discharging direction and all the predetermined number of copies are discharged.

Figure 8:
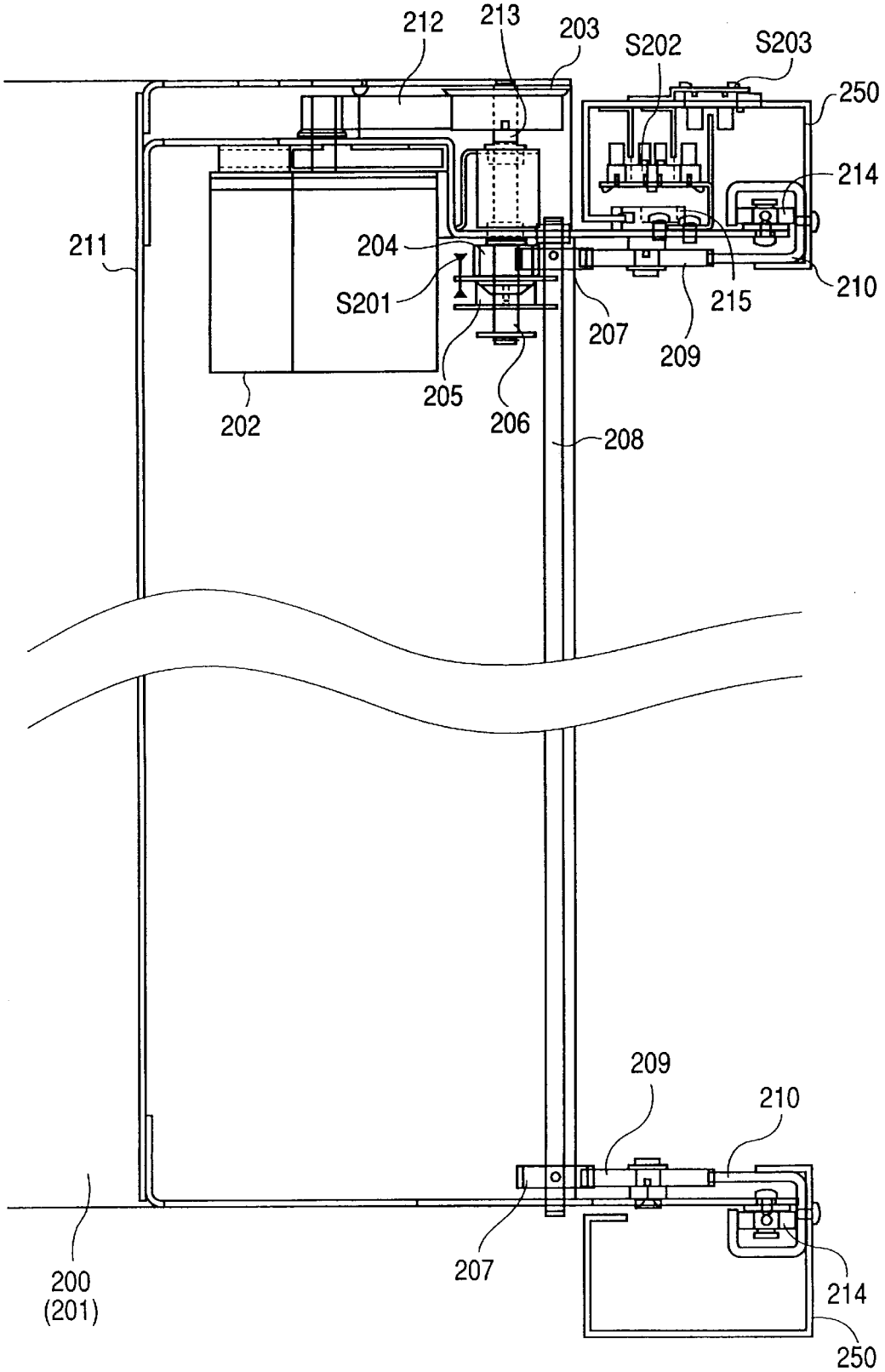
FIG. 8 is a plan view of a stack tray moving mechanism.
Figure 9:
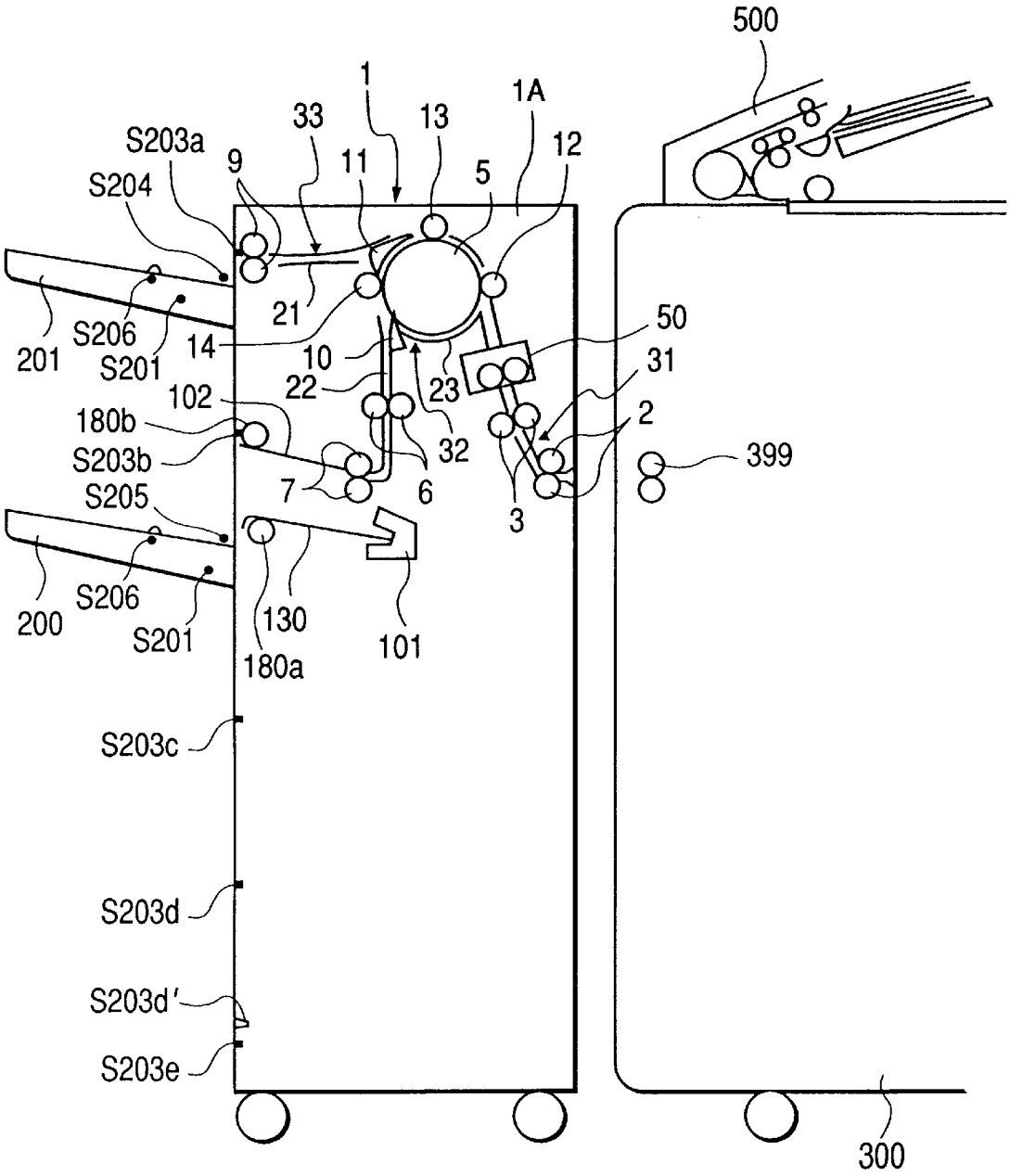
FIG. 9 is a view showing the sensor arrangement around the stacking tray.

In the following, there will be explained the movement of the stacking tray 200 and the sample tray 201 (FIGS. 8 and 9). Prior to the start of operation, the trays 200, 201 wait in the positions of the sheet surface sensors.

As explained in the foregoing, the stacking tray 200 receives the output sheets of copying and printer, and can also receive the sheets processed by the above-described stapler 101 or the unstapled sheets discharged in small bundles. It can stack 2000 sheets at maximum, under the detection by the sensor 203*d*.

If the copying or printing output still continues, the stacking tray 200 is lowered from the position of the sensor S203*d* by a height corresponding to 1000 sheets (to the position of the sensor S203*d*'). Then the sample tray 201 is lowered to the position of the sheet surface sensor S205 for the stacking tray 200 and starts to receive the sheets P again. The sample tray 201 can receive 1000 sheets at maximum, under the detection by the sensor 203*c*.

In case of starting a next job without removing the sheets from the stacking tray 200 after a job not exceeding 2000 sheets, or in case of an interruption in a currently running job, the sheets P can be stacked on the sample tray 201 through the non-sort path 21, though the processing operation is not possible in this case.

The sheet output onto the sample tray 201 through the non-sort path 21 as a normal operation is used, for example, for a sample output of one copy only without processing operation, or in case the sample tray output is designated in the functional sorting.

Now reference is made to FIGS. 22, 23 and 24A to 24E for explaining the features of the present invention in detail. In the present invention, in case the sheets P stacked on the stacking tray 200 develop a deformed portion such as a leaning part, the stacking tray 2000 is elevated and lowered so as to correct such deformed portion.

Figure 22:
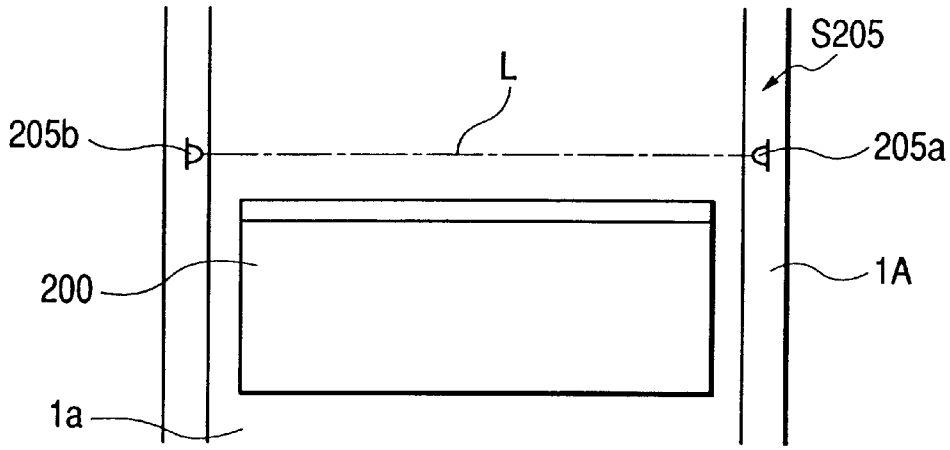
FIG. 22 is a lateral view of a sheet surface sensor and a stacking tray.
Figure 23:
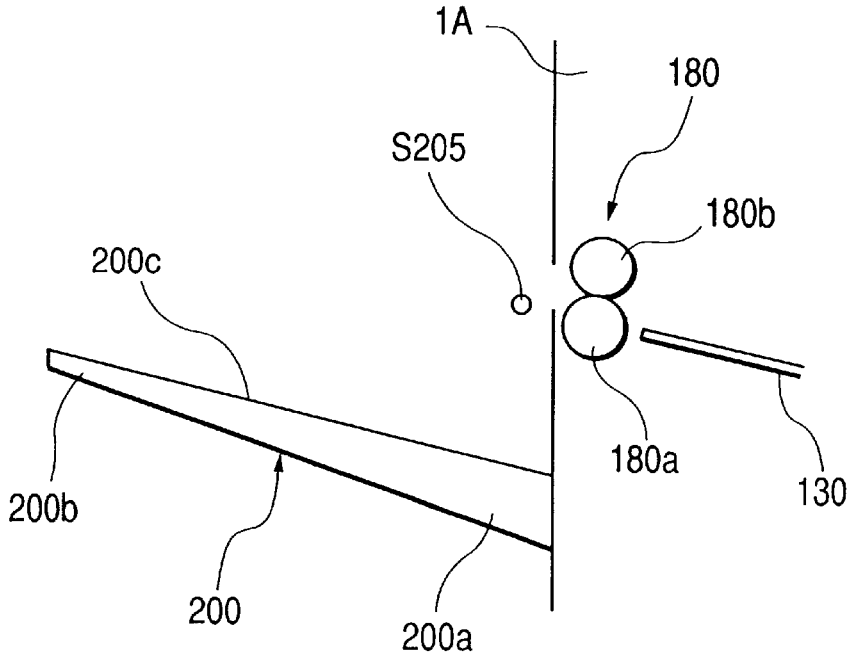
FIG. 23 is an elevation view of a sheet surface sensor and a stacking tray.

As shown in FIGS. 22 and 23, the sheet surface sensor S205 is provided in the vicinity of the bundle discharging lower roller 180*a* in the main body 1A of the sheet processing apparatus and above a base portion 200*a* of the stacking tray 200. The sheet surface sensor S205 is provided with a light emitting unit 205*a* and a light receiving unit 205*b*, which are respectively positioned at the left and right sides above the stacking tray 200 and between which an optical axis L is formed. The light emitting unit 205*a* and the light receiving unit 205*b* mentioned above are so positioned that the optical axis L becomes parallel to the rear edge of the sheets P stacked in a satisfactory state on the stacking tray 200. When the optical axis L is intercepted, the sheet surface sensor S205 sends a detection signal to a control device 930, which in response drives the motor 202 of the stacking tray 200 thereby elevating and lowering the stacking tray 200 as will be explained later.

Figure 24A:
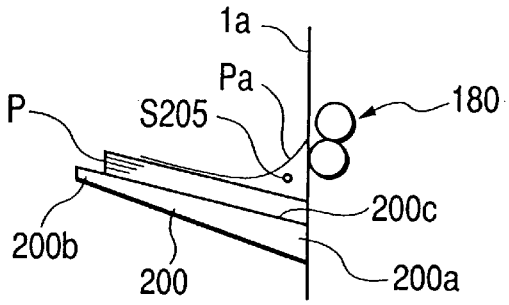
FIGS. 24A, 24B, 24C, 24D and 24E are views showing the function of corrective control for the sheet stacked on the stacking tray.

As shown in FIG. 24A, the sheets P are discharged from the bundle discharging rollers 180 of the sheet processing apparatus 1 and stacked on a stacking face 200*c* so inclined that a front end 200*b* is positioned higher and a base portion 200*a* is positioned lower. The sheet P is discharged on the stacking face 200*c*, then descends along the stacking face 200*c* and stops in a position where the rear end impinges on an outer wall 1*a* of the sheet processing apparatus 1. Thus the sheet P stacked on the stacking face 200*c* or on the already stacked sheets P is in a state where the rear end is in contact with the outer wall 1*a*. In the course of stacking, when the stacked sheets intercept the optical axis L of the sheet surface sensor S205, the sensor S205 sends a detection signal to the control device 930, which in response drives the motor 202 to lower the stacking tray 200. The stacking tray 200 is lowered by an amount to restore the optical axis L of the sheet surface sensor S205. Therefore, when the sheets P continue to be stacked in satisfactorily flat manner on the stacking tray 200, it is lowered in principle, at each stacking of a sheet P, by an amount corresponding to the thickness of the sheet. The functions explained above are executed when the sheets P are satisfactorily stacked.

In the following there will be explained a case when the stacked sheets P develop a deformed portion Pa such as a leaning part.

When the stacked sheet P develops the deformed portion Pa as shown in FIG. 24A, the optical axis L is intercepted by such deformed portion Pa. As FIG. 24A only shows the cross section, it is illustrated as if the optical axis L passes under the deformed portion Pa, but, in fact the deformed portion Pa has different heights on both sides of the sheet P and thus tends to intercept the optical axis.

Figure 24B:
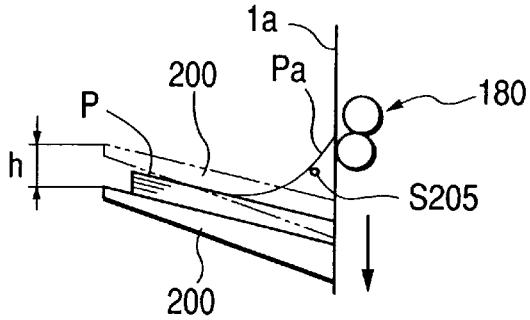
Figure 24C:
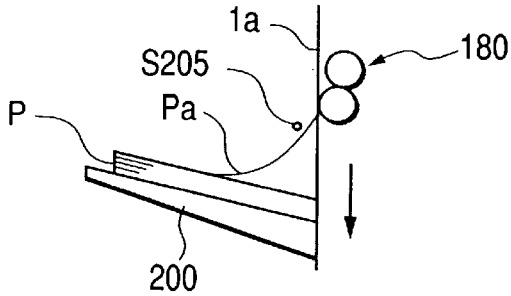
Figure 24D:
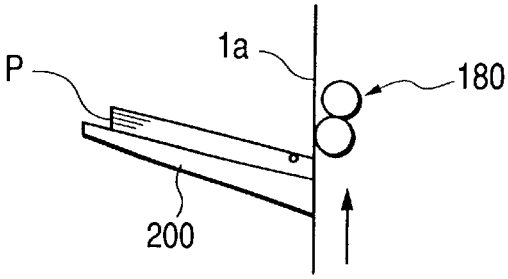
Figure 24E:
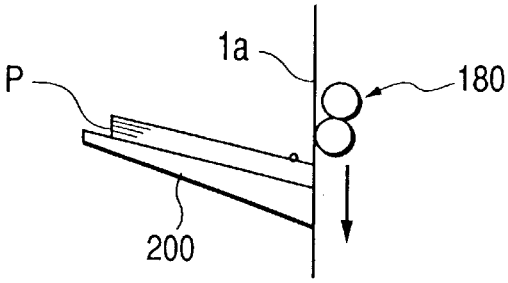
Figure 25:
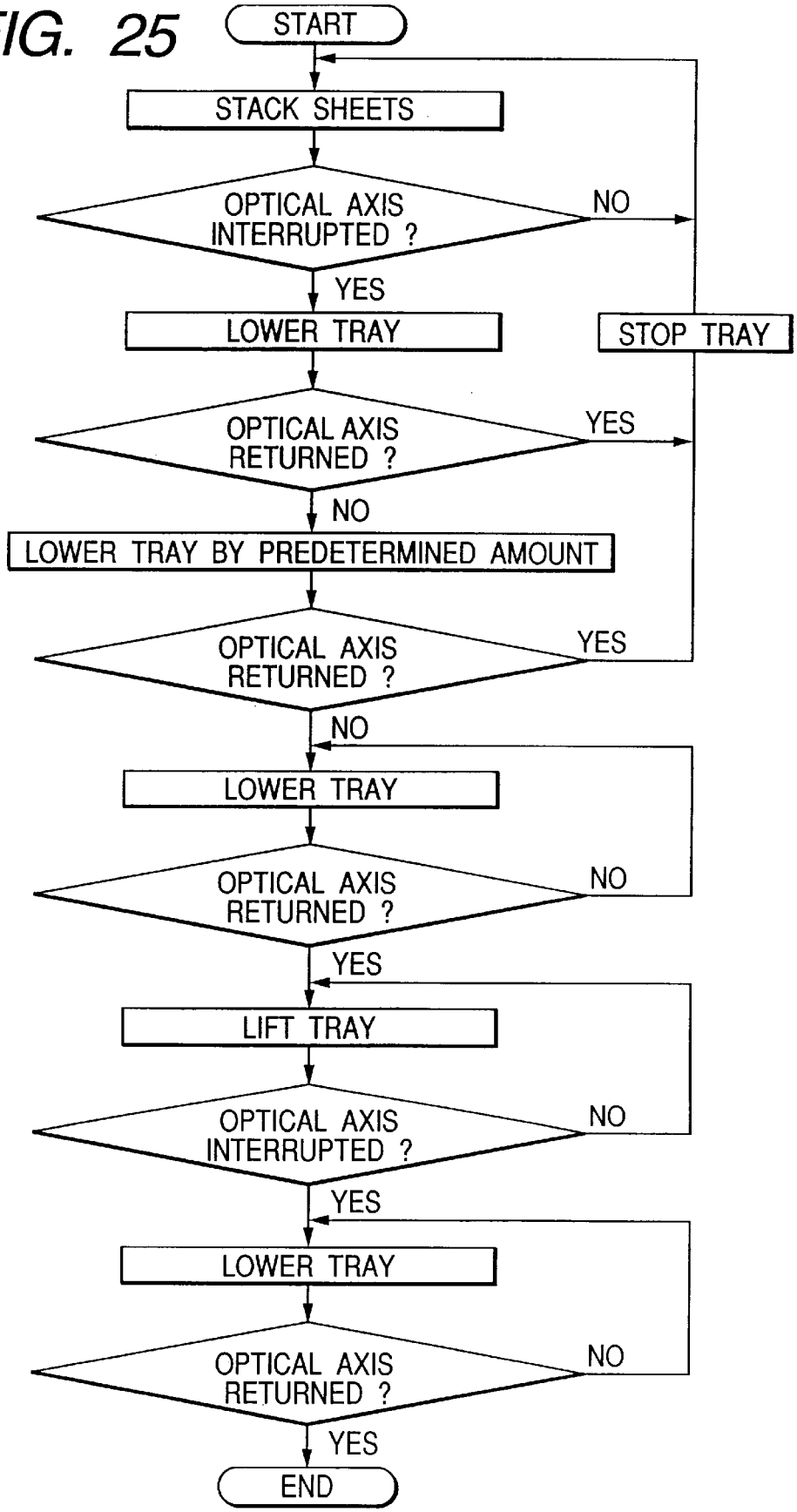
FIG. 25 is a flow chart showing the corrective control for the sheet stacked on the stacking tray.

When the optical axis L is intercepted, the stacking tray 200 is lower as shown in FIG. 24B. If the optical axis L is not restored even when the stacking tray 200 is lowered by a predetermined amount h (for example 10 mm), the lowering is continued until the optical axis is restored as shown in FIG. 24C. Then the stacking tray 200 is elevated until the optical axis is intercepted as shown in FIG. 24D. Then, when the optical axis is intercepted, the stacking tray 200 is lowered until the optical axis is restored as shown in FIG. 24E. Such serial correcting control shown in FIGS. 24A to 24E removes the deformed portion Pa of the sheet P, whereby the upper surface of the sheet P is positioned in the normal position (cf. flow chart in FIG. 25). Also there can be prevented creasing of the deformed portion Pa, caused by successive discharge of the ensuing sheets P on the deformed portion Pa. The above-described correction control of the present invention is particularly effective in case of discharging a bundle of plural sheets or sheets after stapling.

In the foregoing embodiment, the motor 202 constituting the drive source of the stacking tray 200 is provided thereon, but it may also be provided in the main body 1A of the sheet processing apparatus.

In the following there will be explained a second embodiment with reference to FIGS. 26, 27, 28, 29 and 30.

Figure 26:
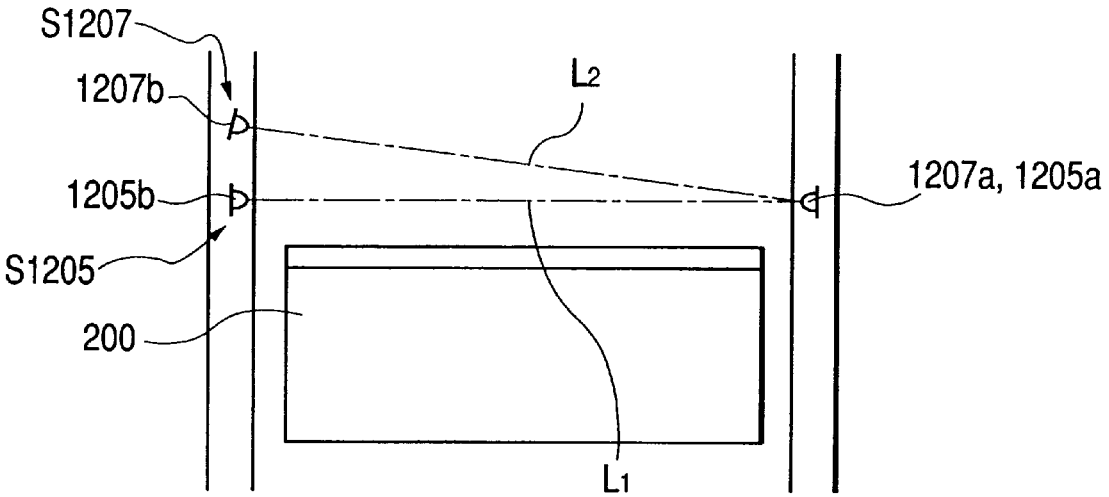
FIG. 26 is a lateral view of a sheet surface sensor and a stacking tray in a second embodiment.
Figure 27:
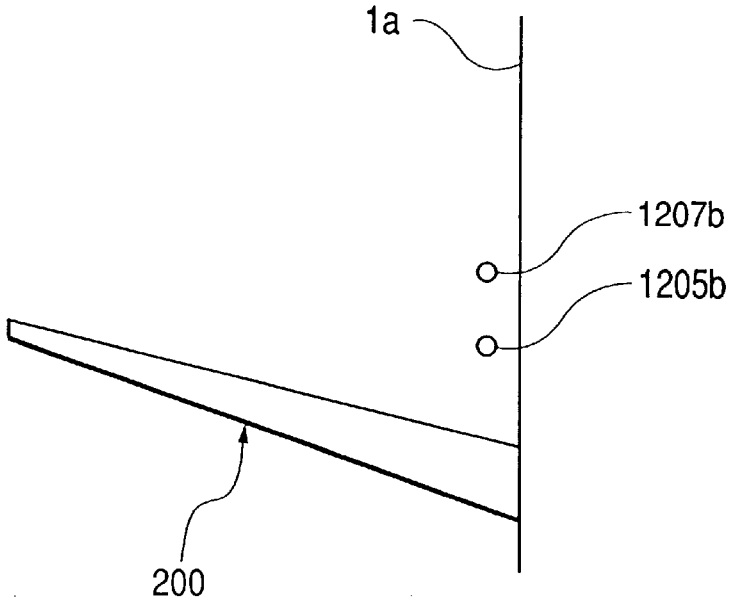
FIG. 27 is an elevation view of a sheet surface sensor and a stacking tray in a second embodiment.
Figure 28:
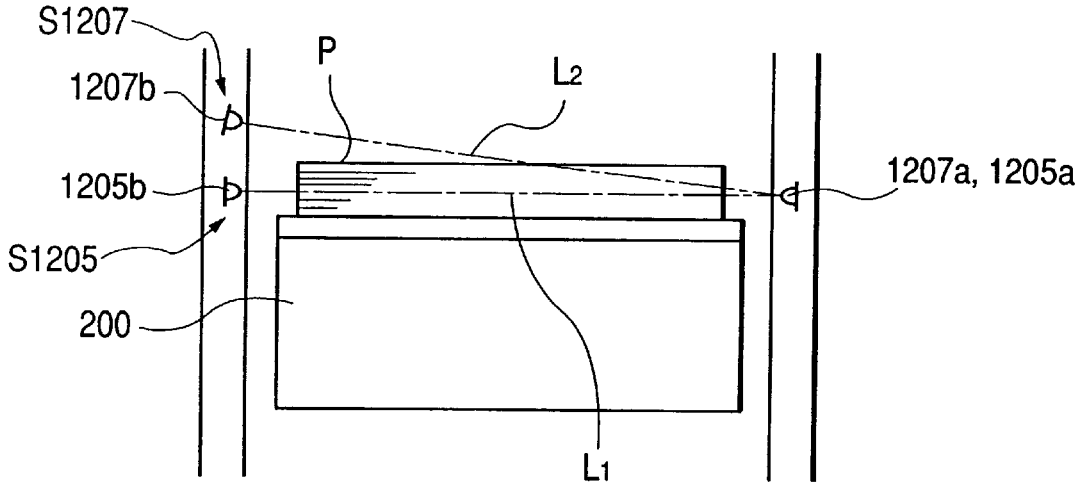
FIG. 28 is a lateral view of the sheet surface sensor and the stacking tray bearing thereon a sheet with a deformed portion.

As shown in FIGS. 26 and 27, a first sheet surface sensor S1205 is provided in the vicinity of the bundle discharging lower roller 180*a* in the main body 1A of the sheet processing apparatus and above a base portion 200*a* of the stacking tray 200. The sheet surface sensor S1205 is provided with a light emitting unit 1205*a* and a light receiving unit 1205*b*, which are respectively positioned at the left and right sides above the stacking tray 200 and between which an optical axis (first optical axis) L1 is formed. The light emitting unit 1205*a* and the light receiving unit 1205*b* mentioned above are so positioned that the optical axis L1 becomes parallel to the rear edge of the sheets P stacked in a satisfactory state on the stacking tray 200. A sheet surface sensor S1207 is also a transmissive photosensor similar to the above-described sheet surface sensor S1205, and has a second optical axis L2 between a light emitting unit 1207*a* and a light receiving unit 1207*b*. The light emitting unit 1207*a* of the second sheet surface sensor S1207 is positioned in the vicinity of that 1205*a* of the first sheet surface sensor. These light emitting units may be provided in mutually adjacent manner, or may be constructed integrally.

The light receiving unit 1207*b* of the second sheet surface sensor S1207 is positioned slightly above the light receiving unit 1205*b* of the first sheet surface sensor S1205. More specifically, while the optical axis L1 of the first sheet surface sensor S1206 is positioned parallel to the rear edge of the sheets P on the stacking tray 200, the optical axis L2 of the second sheet surface sensor S1207 is positioned with a suitable angle to the optical axis L1 of the first sheet surface sensor S1205. The sheet surface sensors S1205, S1207 send, in response to the interception of the optical axes L1, L2, detection signals to the control device 930, which in response drives the motor 202 of the stacking tray 200 to elevate and lower the stacking tray as explained later.

Thus, in the present invention, the upper surface of the uppermost sheet P on the stacking tray 200 is considered to be detected when the optical axes L1 and L2 are both intercepted. For example, when the rear end of the uppermost sheet P leans on the main body 1A of the sheet processing apparatus to develop a deformed portion Pa, the optical axis L1 parallel to the rear edge of the sheet may pass under the deformed portion Pa. In such case, the sheet surface sensor S1205 alone may conduct detection as if the sheet P is stacked in a satisfactorily flat manner, despite of the formation of the deformed portion Pa. In order to avoid such drawback, the second sheet surface sensor S1207 is provided in the present embodiment.

Figure 29:
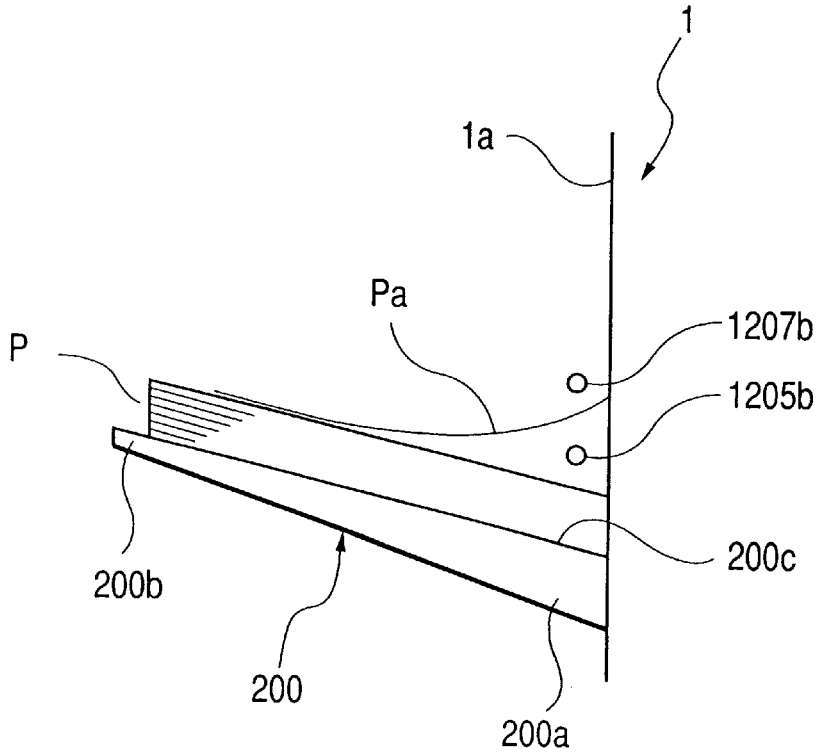
FIG. 29 is an elevation view of the sheet surface sensor and the stacking tray bearing thereon a sheet with a deformed portion.
Figure 30:
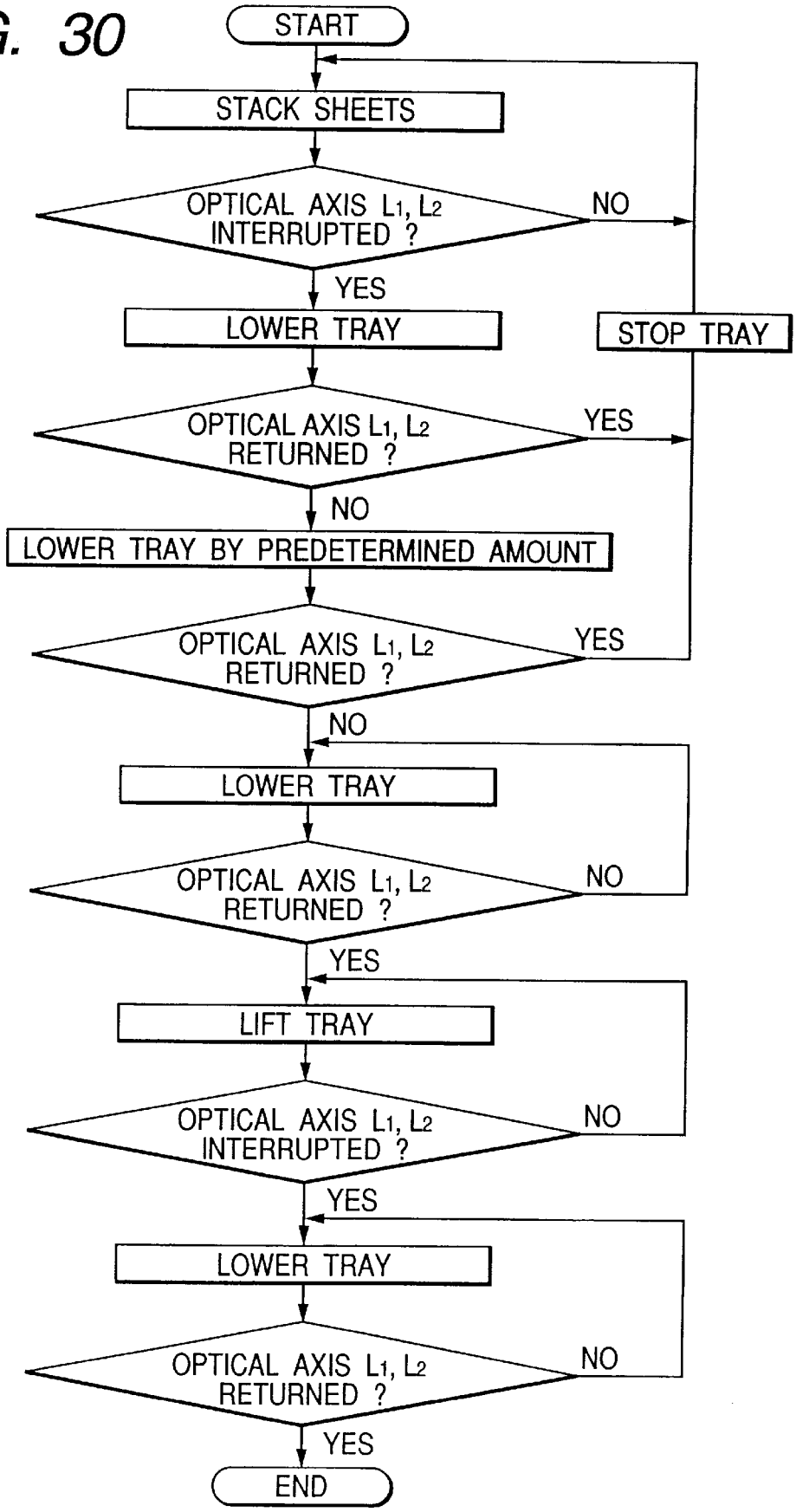
FIG. 30 is a flow chart showing the function of the stacking tray.

As shown in FIG. 29, the sheets P are discharged from the bundle discharging rollers 180 of the main body 1A of the sheet processing apparatus and stacked on a stacking face 200*c* so inclined that a front end 200*b* is positioned higher and a base portion 200*a* is positioned lower. The sheet P is discharged on the stacking face 200*c*, then descends along the stacking face 200*c* and stops in a position where the rear end impinges on the outer wall 1*a*. Thus the sheet P stacked on the stacking face 200*c* or on the already stacked sheets P is in a state where the rear end is in contact with the outer wall 1*a*.

In the course of stacking, when the stacked sheets P intercept the optical axes L1 and L2 of the sheet surface sensors S1205, S1207, they send detection signals to the control device 930, which in response drives the motor 202 to lower the stacking tray 200. The stacking tray 200 is lowered by an amount to restore the optical axes L1, L2 of the sheet surface sensors S1205, S1207. Therefore, when the sheets P continue to be stacked in satisfactorily flat manner on the stacking tray 200, it is lowered in principle, at each stacking of a sheet P, by an amount corresponding to the thickness of the sheet. The functions explained above are executed when the sheets P are satisfactorily stacked.

In the following there will be explained a case where the stacked sheets P develop a deformed portion Pa such as leaning.

When the stacked sheet P develops a deformed portion Pa as shown in FIG. 29, such deformed portion Pa intercepts the optical axis L2 but may not intercept the optical axis L1. When the optical axes L1, L2 are both intercepted, the stacking tray 200 is lowered. If the optical axes L1, L2 are not restored even after the lowering of the stacking tray 200 by a predetermined amount (for example 10 mm), the lowering is continued until the optical axes L1, L2 are restored. When the optical axes L1, L2 are restored, the stacking tray 200 is elevated until the optical axes L1, L2 are intercepted. Then, when the optical axes L1, L2 are intercepted, the stacking tray 200 is lowered until the optical axes L1, L2 are restored (cf. flow chart in FIG. 30). Such serial correcting control removes the deformed portion Pa of the sheet P, whereby the upper surface of the sheet P is positioned in the normal position. Also, there can be prevented creasing of the deformed portion Pa, caused by successive discharge of the ensuing sheets P on the deformed portion Pa. The above-described correction control of the present invention is particularly effective in case of discharging a bundle of plural sheets or sheets after stapling.

Figure 31A:
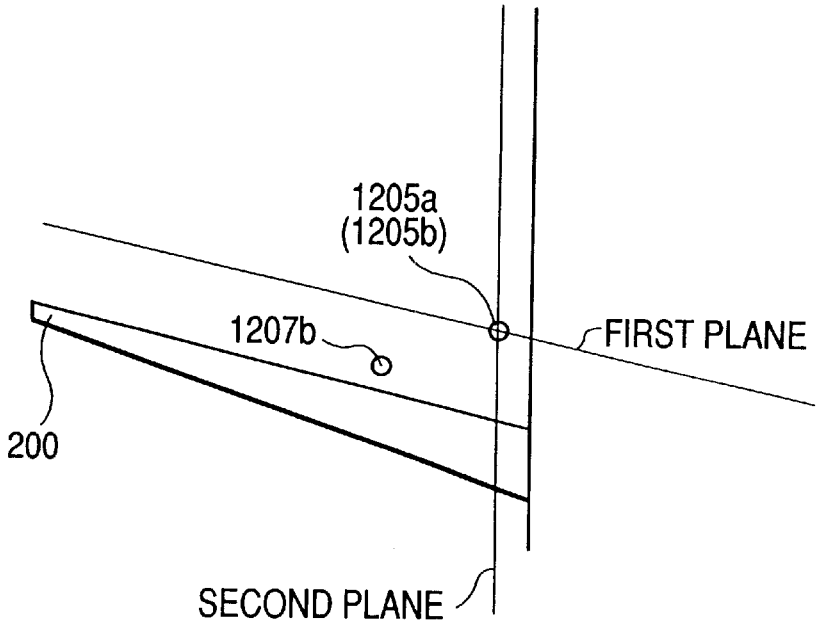
FIGS. 31A and 31B are views showing third and fourth embodiments.
Figure 31B:
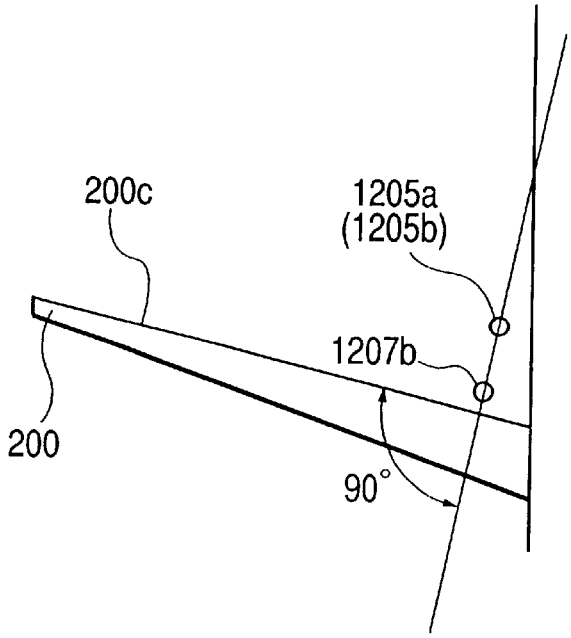

In the foregoing embodiments, the sheet surface sensors S1205, S1207 may also be positioned in the following manner, instead of the positions explained in the foregoing:

(1) The light emitting unit 1207*a* of the second sheet surface sensor S1207 is provided in the vicinity of the first sheet surface sensor S1205, and the light receiving unit 1207*b* of the second sheet surface sensor S1207 is positioned between a first plane containing the first optical axis L1 and parallel to the sheet P on the sheet stacking face 200*c* and a second plate containing the first optical axis L1 and perpendicular to the sheet P (FIG. 31A);

(2) The light receiving unit 1207*b* of the second sheet surface sensor S1207 is positioned on the first plane within the above-mentioned range (1); or (3) The light receiving unit 1205*b* of the first sheet surface sensor S1205 and that 1207*b* of the second sheet surface sensor S1207 are arranged along a line substantially perpendicular to the sheet stacking face 200*c* (FIG. 31B).

What is claimed is:

1. A sheet processing apparatus provided with sheet stacking means supported in vertically movable manner and adapted to support sheets discharged from the main body of said sheet processing apparatus, and elevate/lower means for elevating or lowering said sheet stacking means, comprising:

detection means for outputting a detection signal by detecting an uppermost one among the sheets discharged in succession and stacked on said sheet stacking means; and control means for controlling said elevate/lower means so as to lower said sheet stacking means in response to the detection signal inputted from said detection means;

wherein, said control means after the input of the detection signal from said detection means, if the input of said detection signal is not terminated even after lowering of said sheet stacking means by a predetermined amount, executes a serial control of lowering said sheet stacking means until the input of said detection signal is terminated, then elevating said sheet stacking means until said detection signal is inputted, and lowering said sheet stacking means until said detection signal is terminated.

2. A sheet processing apparatus according to claim 1, wherein said detection means is a transmissive photosensor in which an optical axis is formed between a light emitting unit and a light receiving unit, wherein said detection signal is outputted when said optical axis is intercepted, and said detection signal is terminated when said optical axis is restored.

3. A sheet processing apparatus according to claim 2, wherein said sensor is so positioned that the optical axis thereof is directed transversally to the discharging direction of the sheet, above said sheet stacking means.

4. A sheet processing apparatus according to claim 3, wherein said sensor is so positioned that the optical axis thereof becomes parallel to the rear edge of the sheet on said sheet stacking means, at above a base portion of said sheet stacking means.

5. A sheet processing apparatus according to claim 1, 2, 3 or 4, wherein said elevate/lower means further comprises a drive source provided in said sheet stacking means.

6. A sheet processing apparatus according to claim 1, 2, 3 or 4, wherein said elevate/lower means further comprises a drive source provided in the main body of said sheet processing apparatus.

7. An image forming apparatus provided with an image forming unit for forming an image on a sheet, and a sheet processing apparatus for processing the sheet after image formation, wherein said sheet processing apparatus is a sheet processing apparatus according to claim 1, 2, 3 or 4.

* * * * *

UNITED STATES PATENT AND TRADEMARK OFFICE

CERTIFICATE OF CORRECTION

PATENT NO. : 6,145,826

DATED : November 14, 2000

INVENTOR(S): WATARU KAWATA

It is certified that error appears in the above-identified patent and that said Letters Patent is hereby corrected as shown below:

COLUMN 1:
Line 33, "descends" should read --descend--.
Line 66, "the" (2nd occurrence) should read --an--.

COLUMN 10:
Line 27, "are" should read --is--.
Line 56, "b" (1st occurrence" should read --by--.

COLUMN 11:
Line 16, "descents" should read --descends--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*